US011674304B2

(12) United States Patent
Landreth et al.

(10) Patent No.: US 11,674,304 B2
(45) Date of Patent: Jun. 13, 2023

(54) BRACKET

(71) Applicant: T & R INTERIOR SYSTEMS LIMITED, Porirua (NZ)

(72) Inventors: Hedda Maria Landreth, Porirua (NZ); Stephen Anthony Karl Thwaite, Porirua (NZ); Joseph David Bain, Palmerston North (NZ)

(73) Assignee: T & R INTERIOR SYSTEMS LIMITED, Porirua (NZ)

( * ) Notice: Subject to any disclaimer, the term of this patent is extended or adjusted under 35 U.S.C. 154(b) by 0 days.

(21) Appl. No.: 17/275,010

(22) PCT Filed: Sep. 10, 2019

(86) PCT No.: PCT/IB2019/057598
§ 371 (c)(1),
(2) Date: Mar. 10, 2021

(87) PCT Pub. No.: WO2020/053745
PCT Pub. Date: Mar. 19, 2020

(65) Prior Publication Data

US 2022/0090372 A1 Mar. 24, 2022

Related U.S. Application Data

(60) Provisional application No. 62/821,801, filed on Mar. 21, 2019.

(30) Foreign Application Priority Data

| | | |
|---|---|---|
| Sep. 10, 2018 | (NZ) | 746201 |
| May 30, 2019 | (NZ) | 754060 |
| Jul. 9, 2019 | (NZ) | 755216 |

(51) Int. Cl.
*E04B 1/41* (2006.01)
*E04B 1/61* (2006.01)
*E04B 1/38* (2006.01)

(52) U.S. Cl.
CPC ..... *E04B 1/40* (2013.01); *E04B 1/61* (2013.01); *E04B 2001/405* (2013.01); *E04B 2001/6195* (2013.01)

(58) Field of Classification Search
CPC ..... E04B 1/40; E04B 1/61; E04B 2001/405; E04B 2001/6195; E04B 1/2403;
(Continued)

(56) References Cited

U.S. PATENT DOCUMENTS 2,115,824 A * 5/1938 McRorey ..... E04H 9/021 52/294
3,842,561 A * 10/1974 Wong ..... E04H 9/021 52/506.07
(Continued)

FOREIGN PATENT DOCUMENTS

CA 3035933 3/2018
CN 1860273 11/2006
(Continued)

OTHER PUBLICATIONS

International Search Report for International Application No. PCT/IB2019/057598 dated Dec. 18, 2019 (10 pages).
(Continued)

*Primary Examiner* — Rodney Mintz
(74) *Attorney, Agent, or Firm* — Merchant & Gould P.C.

(57) ABSTRACT

The invention relates to a bracket to restrain a partition wall in the interior of a building. The bracket comprises a body having a generally hollow sheath and a shaft that is slidable within the sheath to adjust the bracket. The bracket is particularly suitable for supporting internal partition walls of
(Continued)

buildings that are located in areas prone to earthquakes and high winds because the bracket allows for the wall to be laterally supported while also accommodating vertical movement experienced during building deflection and inter-storey drift without transferring compression and expansion loads onto the partition wall.

25 Claims, 20 Drawing Sheets

(58) Field of Classification Search
CPC ..... E04B 2001/2415; E04B 2001/2439; E04B 2001/2463; E04B 2001/2481; E04B 2/825; E04H 9/021; E04H 9/0215; E04H 9/0237
See application file for complete search history.

(56) References Cited

U.S. PATENT DOCUMENTS

| | | | | | |
|---|---|---|---|---|---|
| 3,889,937 | A * | 6/1975 | Statler | F16F 7/09 | 267/202 |
| 4,281,487 | A * | 8/1981 | Koller | F16F 7/125 | 52/741.1 |
| 5,125,203 | A * | 6/1992 | Daw | E04B 2/825 | 52/506.06 |
| 5,159,793 | A * | 11/1992 | Deugo | E04B 2/82 | 52/243.1 |
| 5,228,254 | A | 7/1993 | Honeycutt, Jr. | | |
| 5,237,786 | A | 8/1993 | Kochansky | | |
| 6,122,871 | A | 9/2000 | Russell et al. | | |
| 7,765,764 | B2 * | 8/2010 | Zambelli | E04B 1/215 | 52/223.13 |
| 8,024,901 | B2 * | 9/2011 | Gosling | E04B 2/7424 | 52/772 |
| 9,732,517 | B1 * | 8/2017 | Huang | E01D 22/00 | |
| 9,803,353 | B2 * | 10/2017 | Kanno | F17C 3/022 | |
| 9,840,844 | B2 * | 12/2017 | Prowse | E04B 1/5837 | |
| 9,869,085 | B2 * | 1/2018 | Evans | E04B 1/40 | |
| 2002/0189172 | A1 * | 12/2002 | Kaeser | E04B 2/82 | 52/64 |
| 2005/0016112 | A1 | 1/2005 | Franz | | |
| 2006/0059806 | A1 * | 3/2006 | Gosling | E04B 2/7424 | 52/238.1 |
| 2007/0039279 | A1 * | 2/2007 | Zambelli | E04B 1/215 | 52/698 |
| 2008/0250731 | A1 * | 10/2008 | Wheeler | E04B 9/18 | 248/200.1 |
| 2015/0292207 | A1 * | 10/2015 | Prowse | E04B 1/4128 | 52/707 |
| 2016/0251845 | A1 | 9/2016 | Evans et al. | | |
| 2016/0251846 | A1 * | 9/2016 | Kanno | F17C 3/022 | 52/703 |
| 2019/0218774 | A1 * | 7/2019 | Danesi | E04B 2/7401 | |
| 2022/0298777 | A1 * | 9/2022 | Simpson | E04B 2/822 | |

FOREIGN PATENT DOCUMENTS

| | | | | |
|---|---|---|---|---|
| CN | 103890291 | | 6/2014 | |
| CN | 107407092 | | 6/2014 | |
| EP | 3513013 | | 7/2019 | |
| FR | 2863284 | | 6/2005 | |
| JP | H11256732 | A | 9/1999 | |
| JP | 2001-152586 | A | 6/2001 | |
| JP | 2002-242342 | A | 8/2002 | |
| JP | 2017-503097 | A | 1/2017 | |
| JP | 6283863 | | 2/2018 | |
| NZ | 631234 | A * | 12/2015 | E04B 2/824 |
| WO | 2015053639 | A1 | 4/2015 | |
| WO | WO-2015107509 | A1 * | 7/2015 | E04B 2/824 |
| WO | WO-2018051253 | A1 * | 3/2018 | E04B 2/7401 |

OTHER PUBLICATIONS

International Preliminary Report on Patentability for PCT/IB2019/057598 dated Dec. 18, 2019 (8 pages).
First Examination Report for NZ 755216 dated Aug. 19, 2019 (4 pages).
Report on Re-Examination for NZ 755216 dated Jun. 22, 2020 (6 pages).
Report on Re-Examination for NZ 755216 dated Aug. 3, 2020 (4 pages).
Chinese First Office Action and Search Report in Application 201980069648.5, dated Mar. 18, 2022, 9 pages.
Japanese Reason for Refusal in Application 2021-514405, dated Aug. 2, 2022, 4 pages.

* cited by examiner

BRACKET

This application is a National Stage Application of PCT/IB2019/057598, filed 10 Sep. 2019, which claims benefit of Serial No. 746201, filed 10 Sep. 2018 in New Zealand, Serial No. 62/821801, filed 21 Mar. 2019 in the United States, Serial No. 754060, filed 30 May 2019 in New Zealand and Serial No. 755216, filed 9 Jul. 2019 in New Zealand and which applications are incorporated herein by reference. To the extent appropriate, a claim of priority is made to each of the above disclosed applications.

FIELD OF THE INVENTION

This invention relates to a bracket for restraining internal walls, such as glazed or plasterboard partition walls. The bracket is particularly useful for supporting partition walls of buildings in earthquake zones in which the wall may be subjected to vertical movement during a seismic event.

BACKGROUND

Partition walls are commonly used in buildings, especially commercial buildings, to divide spaces within the building. Often partition walls extend from the floor to a suspended ceiling in the building. Partition walls must be laterally braced in a way that does not include a fixed attachment to a suspended ceiling and that instead attaches the partition wall to a supporting overhead structure. This is because during earthquakes for example, lateral movement of a partition wall that is fixed to a suspended ceiling can cause significant damage to the ceiling, endangering people and property below.

It is common to support partition walls by using a bracket or supporting structure that extends between the top of a partition wall and the framing of a ceiling space. These typical wall bracing systems secure partition walls and glazing lines within partition walls to the structure above and prevent lateral movement of the tops of the walls during a seismic event.

New Zealand patent number 631234 discloses a partition wall bracket for attaching a partition wall to an overhead structure while allowing for at least some lateral movement of a suspended ceiling located between the partition wall and the overhead structure.

However, depending on the structural nature of the building, interior walls, such as partition walls, can experience vertical actions and forces as a result of vertical deflection of a building frame caused by inter-storey movement/drift within the building. Inter-storey movement is the result of strong winds and/or earthquake actions/forces that create compression or expansion actions/forces on a building structure, such as the building frame. Partition walls that are subjected to these actions/forces may undergo vertical deflection as a result. Vertical deflection of a partition wall may also result from vertical actions/forces caused by vertical loads on the floor above or due to displacement/settling in the concrete or steel of the floor or structure above to which the partition wall is attached.

Known partition wall brackets do not allow for vertical movement under both compression and expansion actions/forces and therefore do not allow the partition walls to accommodate these vertical actions/forces. As such, partition walls may be subjected to vertical compression and expansion actions/forces during a seismic event, which has the potential to create significant damage to the walls and risk to people nearby, especially if the walls comprise large sheets of glazing. Under large expansion actions for example, the brackets apply tension to the partition wall and the head track may be pulled up, off the glazing, causing the glazing to fall.

Allowance for vertical movement may be provided at the top of the partition wall by utilising a sliding head track that is free to move vertically. This head track is commonly referred to as deflection head track. However, deflection head track may be unsuitable in some instances, especially above mullions/lintels, and may not always be suitable for use in partition wall construction due to the extent of material needed to cover the top edge of a partition wall and the consequent expense. The installation of partition walls with deflection head track is not straight forward, so deflection head track is commonly incorrectly installed.

It is an object of at least preferred embodiments of the present invention to provide a partition wall bracket that addresses one or more of the above-mentioned disadvantages and/or to at least provide the public with a useful alternative.

In this specification where reference has been made to patent specifications, other external documents, or other sources of information, this is generally to provide a context for discussing features of the invention. Unless specifically stated otherwise, reference to such external documents or sources of information is not to be construed as an admission that such documents or such sources of information, in any jurisdiction, are prior art or form part of the common general knowledge in the art.

SUMMARY OF THE INVENTION

In a first aspect, the present invention provides an adjustable partition wall bracket comprising: a first attachment system for attaching the bracket to an upper surface of a partition wall; a second attachment system for attaching the bracket to an upper structure; a shaft; and a sheath comprising a hollow region for slidably receiving a portion of the shaft therein. A lining member is positioned at least partly within the hollow region of the sheath The shaft is slidable relative to the sheath to adjust the bracket.

In one form, the shaft and sheath are slidable relative to each other to automatically adjust the bracket to accommodate vertical displacements between the wall and the upper structure.

In one form, the shaft is longer than the sheath.

In one form, the shaft comprises an extension portion, which is receivable within the hollow region of the sheath, and an attachment portion; and the sheath comprises a stabilising portion and an attachment portion; and wherein the extension portion of the shaft is longer than the stabilising portion of the sheath.

In one form, the first attachment system comprises a threaded nut that engages with a threaded exterior portion of the sheath.

In one form, a portion of the shaft is slidably received within the hollow region of the sheath to move longitudinally within the sheath.

In one form, the shaft is slidable from a position in which a majority portion of the shaft is positioned below a top of the sheath, to a position where a majority portion of the shaft is positioned above a top of the sheath.

In one form, the lining member may comprise a lining sleeve provided between the shaft and the hollow of the sheath. In an embodiment, the lining sleeve is provided on the shaft. In one form, the lining member comprises a coating on an exterior surface of the shaft or an interior surface of the sheath.

In one form, the hollow region of the sheath extends from a first end of the sheath to a second end of the sheath to form a tubular sheath.

In one form, the shaft comprises an exterior surface that has a shape corresponding to the shape of an interior surface of the hollow region of the sheath. For example, the hollow region of the sheath may comprise a circular cross-section and the shaft is a generally cylindrical.

In one form, wherein the bracket comprises a biasing member to bias the device towards a desired position. The biasing member may comprise a spring. In one embodiment, the biasing member biases the bracket to a neutral, installation position.

In one form, the partition wall comprises a head track, and the first attachment system attaches to the head track.

In one form, the first attachment system comprises a nut and washer assembly to clamp to the head track of the partition wall. Alternatively, the first attachment system may comprises a plate for attaching with screws to a top surface of the partition wall, for example.

In one form, the second attachment system comprises first and second clamping members. The first and second clamping members may each comprise a nut for clamping against opposing sides of an upper structure.

In one form, the upper structure comprises one or more lateral support brackets for attaching to an overhead structure, to restrain lateral movement of the partition wall.

In one form, the, or each lateral support bracket comprises an angled portion and a substantially horizontal portion. The angled portion may extend at a 45 degree angle, at a 90 degree angle or other angle. In one embodiment the support bracket comprises a U-shaped channel member.

In one form, the sheath comprises a first end and a second end, wherein the first end is attachable to the first attachment system.

In one form, the shaft comprises an attachment portion located at or near an end of the shaft for engaging with the second attachment system In one form, the first attachment system is provided at or near one end of the shaft and the second attachment system engages with the sheath. In an embodiment, the sheath is slidable from at or near a first, lower end of the shaft to at or near a second, upper end of the shaft. A stop may be provided at or near a second end of the shaft to limit movement of the sheath along the shaft.

In one form, the sheath is about 20 mm (about 0.79 inches) to about 60 mm (about 2.36 inches) long, for example the sheath may be about 25 mm (about 0.98 inches) to about 60 mm (about 2.36 inches) long, or may be about 50 mm (about 1.97 inches) to about 60 mm (about 2.36 inches) long. In one form, the sheath is about 30 mm (about 1.18 inches) to about 70 mm (about 2.75 inches) long.

In one form, the shaft is about 70 mm (about 2.75 inches) to about 150 mm (about 5.90 inches) long.

In one form, the shaft or the sheath or both comprise stainless steel.

In one form, the shaft is longitudinally movable between about +/− 5 mm (about +/−0.02 inches) and about +/−75 mm (about +/−2.95 inches), preferably being longitudinally movable between about +/−50 mm (about +/−1.97 inches) and about +/−75 mm (about +/−2.95 inches) from a neutral position.

In one form, a locking member extends through the shaft and/or the sheath. For example, the locking member may comprise a cable tie that may extend through one of the shaft or the sheath to limit downwards movement of the shaft relative to the sheath. In one embodiment, the locking member extends through both the shaft and the sheath.

In a second aspect, the invention provides an adjustable partition wall bracket comprising: a first attachment system for attaching the bracket to an upper surface of a partition wall; a second attachment system for attaching the bracket to an upper structure; a shaft; a sheath comprising a hollow region for slidably receiving a portion of the shaft therein; and a locking member extending through the shaft and/or the sheath. Upon removing the locking member, the shaft is slidable relative to the sheath to adjust the bracket.

In one form, the shaft and sheath are slidable relative to each other to automatically adjust the bracket to accommodate vertical displacements between the wall and the upper structure. The shaft may be longer than the sheath.

In one form, the shaft comprises an extension portion, which is receivable within the hollow region of the sheath, and an attachment portion. The sheath may comprise a stabilising portion and an attachment portion. The extension portion of the shaft is preferably longer than the stabilising portion of the sheath.

In one form the first attachment system comprises a threaded nut that engages with a threaded exterior portion of the sheath.

In one form a portion of the shaft is slidably received within the hollow region of the sheath to move longitudinally within the sheath.

In one form, the shaft is slidable from a position in which a majority portion of the shaft is positioned below a top of the sheath, to a position where a majority portion of the shaft is positioned above a top of the sheath.

In one form, a lining member is positioned within the hollow region of the sheath. Preferably, the lining member is a lining sleeve provided between the shaft and the hollow of the sheath. In one form, the lining sleeve is provided on at least a portion of the shaft. Optionally, the lining member comprises a coating on an exterior surface of the shaft or an interior surface of the sheath.

In one form, the hollow region of the sheath extends from a first end of the sheath to a second end of the sheath to form a tubular sheath.

In one form, the shaft comprises an exterior surface that has a shape corresponding to the shape of an interior surface of the hollow region of the sheath. Preferably, the hollow region of the sheath comprises a circular cross-section and the shaft is a generally cylindrical.

In one form, the bracket comprises a biasing member to bias the device towards a desired position. In one form, the biasing member comprises a spring. In one form, the biasing member biases the bracket to a neutral, installation position.

In one form, the partition wall comprises a head track, and the first attachment system attaches to the head track. The first attachment system may comprise a nut and washer assembly to clamp to the head track of the partition wall.

In one form, the first attachment system comprises a plate for attaching with screws to a top surface of the partition wall.

In one form, the second attachment system comprises first and second clamping members.

In one form, the first and second clamping members each comprise a nut for clamping against opposing sides of an upper structure.

In one form, the upper structure comprises one or more lateral support brackets for attaching to an overhead structure, to restrain lateral movement of the partition wall.

Optionally, the or each lateral support bracket comprises an angled portion and a substantially horizontal portion. In one form, the angled portion extends at a 45 degree angle.

In one form, the sheath comprises a first end and a second end, wherein the first end is attachable to the first attachment system.

In one form, the shaft comprises an attachment portion located at or near an end of the shaft for engaging with the second attachment system.

In one form, the first attachment system is provided at or near one end of the shaft and the second attachment system engages with the sheath. In one embodiment, the sheath is slidable from at or near a first, lower end of the shaft to at or near a second, upper end of the shaft. A stop may be provided at or near a second end of the shaft to limit movement of the sheath along the shaft.

In one form, the sheath is about 20 mm (about 0.79 inches) to about 60 mm (about 2.36 inches) long. Optionally, the sheath is about 50 mm (about 1.97 inches) to about 60 mm (about 2.36 inches) long. In one form, the sheath is about 30 mm (about 1.18 inches) to about 70 mm long (about 2.75 inches).

In one form, the shaft is about 70 mm (about 2.75 inches) to about 150 mm (about 5.90 inches) long.

In one form, the shaft or the sheath or both comprise stainless steel.

In one form, the shaft is longitudinally movable between about +/−5 mm (about +/−0.02 inches) and about +/−75 mm (about +/−2.95 inches).

In one form, the shaft is longitudinally movable between about +/−50 mm (about +/−1.97 inches) to and about +/−75 mm (about +/−2.95 inches) from a neutral position.

In one form, the locking member is a cable tie that extends through one of the shaft or the sheath to limit downwards movement of the shaft relative to the sheath. In one form, the locking member extends through both the shaft and the sheath.

In a third aspect, the invention provides an adjustable partition wall bracket comprising: a first attachment system for attaching the bracket to an upper surface of a partition wall; a second attachment system for attaching the bracket to an upper structure; a shaft; a sheath comprising a hollow region for slidably receiving a portion of the shaft therein; and a lining member positioned at least partly within the hollow region of the sheath. The shaft and the sheath are slidable relative to each other to automatically adjust the bracket to accommodate vertical displacements between the wall and the upper structure.

In one form, the shaft is longer than the sheath.

In one form, the shaft comprises an extension portion, which is receivable within the hollow region of the sheath, and an attachment portion; and the sheath comprises a stabilising portion and an attachment portion. The extension portion of the shaft is longer than the stabilising portion of the sheath.

In one form, the first attachment system comprises a threaded nut that engages with a threaded exterior portion of the sheath.

In one form, a portion of the shaft is slidably received within the hollow region of the sheath to move longitudinally within the sheath.

In one form, the shaft is slidable from a position in which a majority portion of the shaft is positioned below a top of the sheath, to a position where a majority portion of the shaft is positioned above a top of the sheath.

In one form, a lining member is positioned within the hollow region of the sheath. In one embodiment, the lining member is a lining sleeve provided between the shaft and the hollow of the sheath. The lining sleeve may be provided on at least a portion of the shaft. In one form, the lining member comprises a coating on an exterior surface of the shaft or an interior surface of the sheath.

In one form, the hollow region of the sheath extends from a first end of the sheath to a second end of the sheath to form a tubular sheath.

In one form, the shaft comprises an exterior surface that has a shape corresponding to the shape of an interior surface of the hollow region of the sheath.

In one form, the hollow region of the sheath comprises a circular cross-section and the shaft is a generally cylindrical.

In one form, the bracket comprises a biasing member to bias the device towards a desired position. Optionally, the biasing member comprises a spring. In one form, the biasing member biases the bracket to a neutral, installation position.

In one form, the partition wall comprises a head track, and the first attachment system attaches to the head track.

In one form, the first attachment system comprises a nut and washer assembly to clamp to the head track of the partition wall.

In one form, the first attachment system comprises a plate for attaching with screws to a top surface of the partition wall.

In one form, the second attachment system comprises first and second clamping members.

In one form, the first and second clamping members each comprise a nut for clamping against opposing sides of an upper structure.

In one form, the upper structure comprises one or more lateral support brackets for attaching to an overhead structure, to restrain lateral movement of the partition wall.

In one form, the or each lateral support bracket comprises an angled portion and a substantially horizontal portion. In one embodiment, the angled portion extends at a 45 degree angle.

In one form, the sheath comprises a first end and a second end, wherein the first end is attachable to the first attachment system.

In one form, the shaft comprises an attachment portion located at or near an end of the shaft for engaging with the second attachment system.

In one form, the first attachment system is provided at or near one end of the shaft and the second attachment system engages with the sheath. In one embodiment, the sheath is slidable from at or near a first, lower end of the shaft to at or near a second, upper end of the shaft. A stop may be provided at or near a second end of the shaft to limit movement of the sheath along the shaft.

In one form, the sheath is about 20 mm (about 0.79 inches) to about 60 mm (about 2.36 inches) long. Optionally, the sheath is about 50 mm (about 1.97 inches) to about 60 mm about (2.36 inches) long. In one form, the sheath is about 30 mm (about 1.18 inches) to about 70 mm (about 2.75 inches) long.

In one form, the shaft is about 70 mm (about 2.75 inches) to about 150 mm (about 5.90 inches) long.

In one form, the shaft or the sheath or both comprise stainless steel.

In one form, the shaft is longitudinally movable between about +/−5 mm (about +/−0.02 inches) and about +/−75 mm (about +/−2.95 inches).

In one form, the shaft is longitudinally movable between about +/−50 mm (about +/−1.97 inches) and about +/−75 mm (about +/−2.95 inches) from a neutral position.

In one form, the partition wall bracket further comprises a locking member extending through the shaft and/or the sheath. In one embodiment, the locking member is a cable tie that extends through one of the shaft or the sheath to limit downwards movement of the shaft relative to the sheath. Optionally, the locking member extends through both the shaft and the sheath.

Also described herein is a length adjustable partition wall bracket comprising: a shaft; and a sheath comprising a hollow region for receiving a portion of the shaft therein, wherein the shaft is slidable within the sheath to adjust the length of the bracket.

In one form, the sheath comprises a first end and a second end, wherein the first end is attachable to a first attachment system.

Preferably, the hollow region of the sheath comprises an opening located at the second end of the sheath.

In one form, the shaft comprises a first end and a second end, wherein the first end of the shaft is received within the hollow region of the sheath and wherein the second end of the shaft extends from the sheath.

Optionally, the hollow region of the sheath extends from the first end of the sheath to the second end of the sheath to form a tubular sheath.

In one form, the hollow region of the sheath comprises a circular lateral cross-section. Preferably, the shaft is a generally cylindrical shape.

Preferably, the sheath has a generally cylindrical shape.

Optionally, the sheath is about 20 mm (about 0.79 inches) to about 60 mm (about 2.36 inches) long, for example about 25 mm (about 0.98 inches) to about 60 mm (about 2.36 inches) long, or about 50 mm (about 1.97 inches) to about 60 mm (about 2.36 inches) long. In one form, the sheath is about 30 mm (about 1.18 inches) to about 70 mm (about 2.75 inches) long.

Optionally, the shaft is about 70 mm (about 2.75 inches) to about 150 mm (about 5.90 inches) long.

In one form, the sheath is elongate and comprises a stabilising portion and an attachment portion. The attachment portion may be adapted to engage with the first attachment system.

In one form, the shaft comprises an extension portion, which is receivable within the hollow region of the sheath, and an attachment portion, which may be adapted to engage with a second attachment system. Preferably, the extension portion of the shaft is longer than the stabilising portion of the sheath.

In one form, the shaft is configured to move between about +/−5 mm (about +/−0.02 inches) and about +/−75 mm (about +/−2.95 inches) along a longitudinal axis of the bracket, preferably between about +/−50 mm (about 1.97 inches) and about +/−75 mm (about 2.95 inches) along the longitudinal axis of the bracket.

Optionally, the bracket is attachable to a wall structure. Preferably, the wall structure is a head track of a partition wall. The head track may be a metal head track or a timber head track.

In one form, the first attachment system comprises a threaded nut that engages with a threaded exterior portion of the sheath.

In one form, the second attachment system comprises first and second clamping members for clamping against opposing sides of an upper structure. Optionally, the first and second clamping members each comprise a nut and the upper structure comprises a lateral support bracket to restrain lateral movement of the partition wall.

Preferably, the bracket comprises a locking member to lock the shaft and sheath in a neutral position.

In one form, the bracket comprises a lining member positioned within the hollow region of the sheath.

In one form, the partition wall bracket is attached to a lateral support bracket comprising one or more rigid connectors, each comprising an angled portion extending from the partition wall bracket at an angle. Preferably, the angled portion extends at a 45 degree angle. Optionally, the rigid connector(s) comprise a horizontal portion adapted to attach to the shaft.

In one form, the shaft or the sheath or both comprise stainless steel.

Also described herein is a partition wall bracket comprising: a first attachment system for attaching the bracket to an upper surface of a wall structure; a second attachment system for attaching the bracket to an upper structure; and a body located between the first and second attachment members. The body comprises: a shaft; and a sheath comprising an opening to a hollow region within the sheath. A portion of the shaft is slidably received within the hollow region of the sheath to move longitudinally within the sheath.

Preferably, the sheath comprises a first end and a second end, wherein the first end is attachable to the first attachment system and wherein the opening to the hollow region of the sheath is located at the second end of the sheath.

Preferably, the shaft comprises a first end and a second end, wherein the first end of the shaft is received within the hollow region of the sheath and wherein the second end of the shaft extends from the sheath.

In one form, the hollow region of the sheath extends from the first end of the sheath to the second end of the sheath to form a tubular sheath. Optionally, the hollow region of the sheath comprises a circular lateral cross-section.

In one form, the shaft is a generally cylindrical shape.

Preferably, the sheath has a generally cylindrical shape.

In one form, the sheath is about 50 mm (about 1.97 inches) to about 60 mm (about 2.36 inches) long. In one form, the sheath is about 30 mm (about 1.18 inches) to about 70 mm (about 2.75 inches) long.

Preferably, the shaft is about 70 mm (about 2.75 inches) to about 150 mm (about 5.90 inches) long.

Preferably, the sheath is elongate and comprises a stabilising portion and an attachment portion adapted to engage with the first attachment system.

Preferably, the shaft comprises an extension portion, which is receivable within the hollow region of the sheath, and an attachment portion adapted to engage with the second attachment system.

Preferably, the extension portion of the shaft is longer than the stabilising portion of the sheath.

In one form, the shaft is configured to move between about +/−5 mm (about +/−0.02 inches) and about +/−75 mm (about +/−2.95 inches) along the longitudinal axis of the body.

Preferably, the wall structure is a head track of a partition wall. The head track may be a metal head track or a timber head track.

In one form, the first attachment system comprises a threaded nut that engages with a threaded exterior portion of the sheath.

In one form, the second attachment system comprises first and second clamping members for clamping against opposing sides of an upper structure. Optionally, the first and second clamping members each comprise a nut and the upper structure comprises lateral bracing to restrain lateral movement of the partition wall.

Preferably, the bracket comprises a locking member to lock the shaft and sheath in a neutral position.

In one form, the bracket comprises a lining member positioned within the hollow region of the sheath.

In one form, the partition wall bracket is attached to a lateral support bracket comprising one or more rigid connectors, each comprising an angled portion extending from the partition wall bracket at an angle. Preferably, the angled portion extends at a 45 degree angle. Optionally, the rigid connector(s) comprise a horizontal portion adapted to attach to the shaft.

In one form, the shaft or the sheath or both comprise stainless steel.

Also described herein is an adjustable partition wall bracket comprising a shaft, and a sheath with a hollow region for slidably receiving a portion of the shaft therein. The shaft or sheath comprises an attachment system for attachment to a partition wall, and the other of the shaft or sheath comprises an attachment system for attaching to an upper structure such as bracing, to laterally support the wall, and the shaft and sheath are slidable relative to each other to automatically adjust the bracket to accommodate vertical displacements between the wall and the upper structure.

In one form, the shaft comprises an attachment system to attach to an upper structure and the sheath comprises an attachment system for attachment to a partition wall.

In one form, the shaft is slidable from a position in which a majority portion of the shaft is positioned below a top of the sheath, to a position where a majority portion of the shaft is positioned above a top of the sheath.

In one form, the sheath comprises an attachment system to attach to an upper structure and the shaft comprises an attachment system for attachment to a partition wall.

In one form, the sheath is slidable from at or near a first, lower end of the shaft to at or near a second, upper end of the shaft.

In one form, a stop is provided at or near a second end of the shaft to limit movement of the sheath along the shaft.

In one form, the shaft is longer than the sheath.

In one form, the attachment system for attachment to a partition wall comprises a nut and washer assembly to clamp the head track of a partition wall.

In one form, the attachment system for attachment to a partition wall comprises a plate for attaching with screws to a top surface of the partition wall.

In one form, the bracket further comprises a lining sleeve provided between the shaft and the hollow of the sheath.

In one form, the lining sleeve is provided on the shaft.

In one form, the bracket comprises a biasing member to bias the sheath or shaft to a desired position. The biasing member may comprise a spring. The biasing member may bias the bracket to a neutral, installation position.

In one form the shaft comprises an exterior surface that is shaped to correspond with the shape of the interior surface of the hollow region of the sheath.

This invention may also be said broadly to consist in the parts, elements and features referred to or indicated in the specification of the application, individually or collectively, and any or all combinations of any two or more said parts, elements or features. Where specific integers are mentioned herein which have known equivalents in the art to which this invention relates, such known equivalents are deemed to be incorporated herein as if individually described.

The term 'comprising' as used in this specification and claims means 'consisting at least in part of'. When interpreting statements in this specification and claims that include the term 'comprising', other features besides those prefaced by this term can also be present. Related terms such as 'comprise' and 'comprised' are to be interpreted in a similar manner.

It is intended that reference to a range of numbers disclosed herein (for example, 1 to 10) also incorporates reference to all rational numbers within that range and any range of rational numbers within that range (for example, 1 to 6, 1.5 to 5.5 and 3.1 to 10). Therefore, all sub-ranges of all ranges expressly disclosed herein are hereby expressly disclosed.

As used herein the term '(s)' following a noun means the plural and/or singular form of that noun. As used herein the term 'and/or' means 'and' or 'or', or where the context allows, both.

BRIEF DESCRIPTION OF THE DRAWINGS

The present invention will now be described by way of example only and with reference to the accompanying drawings, in which:

FIG. 5*b* shows the bracket attached to a partition wall with plasterboard cladding;

FIG. 17*a* shows the bracket in a neutral position, FIG. 17*b* shows the bracket in an extended position, and FIG. 17*c* shows the bracket in a contracted position;

FIG. 8*a* is a perspective view of the bracket installed on a timber beam, and FIG. 8*b* is a detail exploded view showing the first attachment system between the bracket and the timber;

FIG. 26A is a perspective view and FIG. 26B is a side view. In other forms, the bracket of FIGS. 26A and 26B may be fitted to a head track in the first instance, rather than being retrofitted;

DETAILED DESCRIPTION OF PREFERRED EMBODIMENTS

Figure 1:
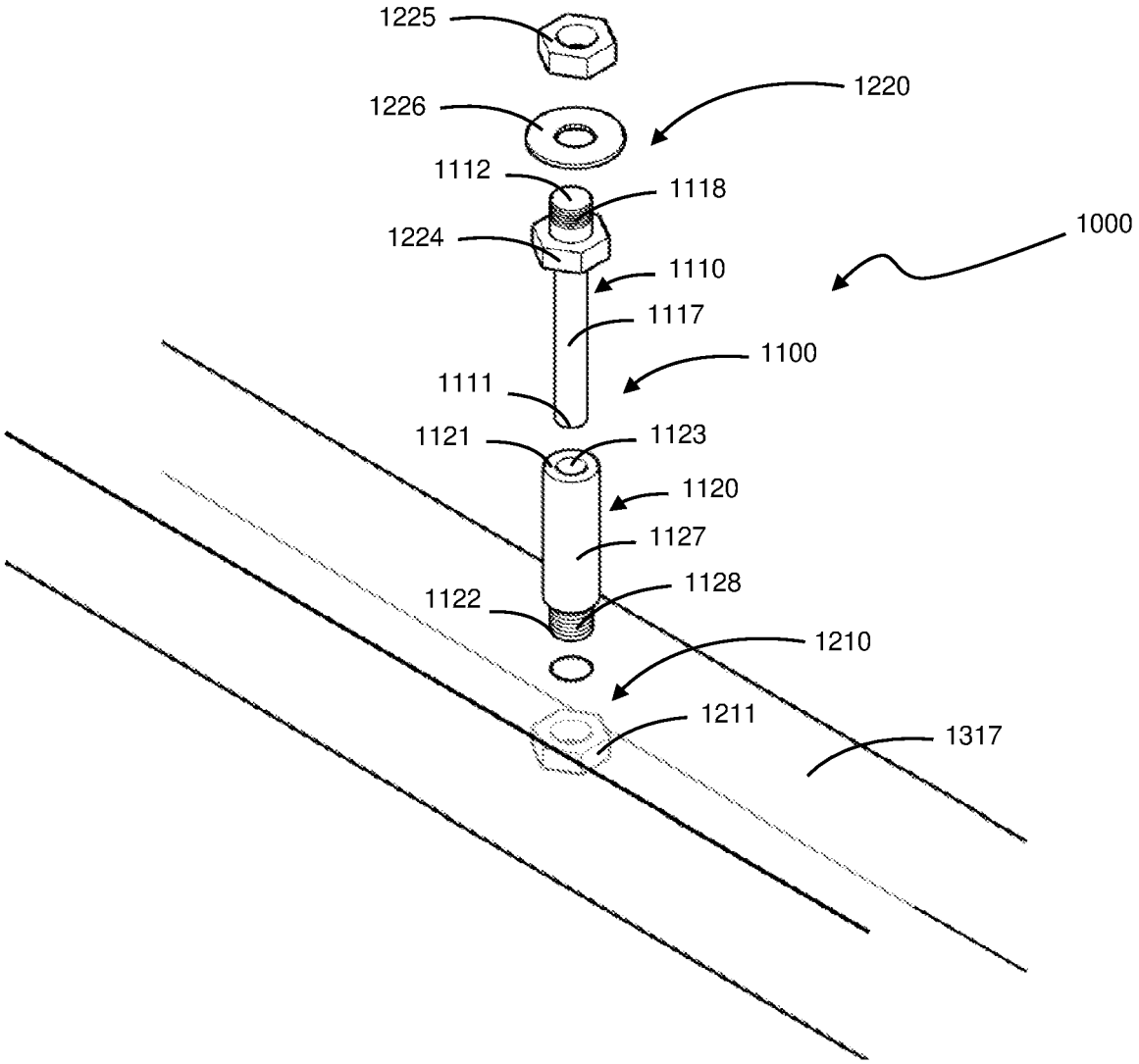
FIG. 1 is an exploded isometric view of a partition wall bracket according to one form of the invention.

The partition wall bracket of the invention is adapted to attach the upper surface of a partition wall to a structure above, sometimes referred to as a structure over. The body of the bracket is able to move freely along the vertical axis and is optionally attached to lateral bracing to laterally restrain the partition wall to the overhead structure.

FIGS. 1 to 25 show exemplary embodiments of partition wall brackets 1000, 1001, 1002, 1003 according to the invention. The bracket is configured to support a vertical partition wall 2000 within a building interior and to allow for the wall to accommodate vertical actions (due to forces and loads), such as during an earthquake or high winds that may lift the roof of a building up and away from partition walls beneath. The bracket may be particularly useful to support partition walls of buildings in earthquake zones during a seismic event and allows for vertical deflection, such as inter-storey deflection, while also restraining the partitions laterally. The bracket 1000 connects a partition wall 2000 to an upper structure 3000. The upper structure may be overhead framing, or a structural ceiling or the upper structure may be a lateral support bracket/bracing bracket 3100, 3180 that connects to an overhead structure, such as overhead framing, or a structural ceiling. A lateral support bracket such as an angle bracket 3100, 3150, 3160, or channel bracket 3180, may be connected to the partition wall bracket 1000 to attach the bracket 1000, and therefore the partition wall 2000, to the overhead structure (such as to overhead framing or a structural ceiling) in a way that inhibits lateral/horizontal movement of the partition wall.

In some forms, the partition wall bracket 1000 is able to automatically vary in length to compensate for vertical compression and expansion actions/forces. In this way, the partition wall bracket 1000 is able to restrain a partition wall 2000 that is exposed to vertical actions/forces within the building structure, such as during seismic events.

In one form, the partition wall bracket 1000 comprises a body 1100 and an attachment system 1200 at each end of the body. A first attachment system 1210 is located at a first end of the body 1100 and is configured to attach the bracket 1000 to a partition wall 1300, such as the upper surface of a partition wall or a head track 1310 that is attached to the upper surface of a wall. The head track 1310 may be of any suitable form, such as a length of timber 1311, or steel studs or a metal bracket 1315, such as an aluminium extrusion. The head track 1310 acts as the structural top of a partition wall. In one form, the head track is a generally u-shaped metal bracket/element 1315, such as an aluminium extrusion or folded steel. In this form, the arms 1316 of the u-shaped bracket 1315 extend down along a portion of opposing sides of the wall studs (inside the linings (sheets) where applicable). The central portion 1317 of the u-shaped bracket 1315 rests on top of the upper surface of the wall 2000.

The second attachment system 1220 is configured to attach the bracket 1000 to an upper structure 3000, such as to a lateral support bracket 3100, 3150, 3160, 3180, to bridging members to avoid services in the plenum, a beam, structural ceiling, or other type of framing for example. Typically, the second attachment system 1220 will attach the partition wall bracket 1000 to a lateral support bracket 3100, 3150, 3160, 3180 or tension member restraint 3170 that is configured to support the partition wall 2000 laterally by limiting or preventing lateral movement of the partition wall 2000. Many different types of lateral forms of restraint can be used with the partition wall bracket of the invention. FIGS. 5, 6, 8 to 11, 13, 19 to 21, and 25 show examples of lateral support brackets or restraints 3100, 3150, 3160, 3170, 3180 that can be used with the partition wall bracket 1000 of the invention.

Figure 11:
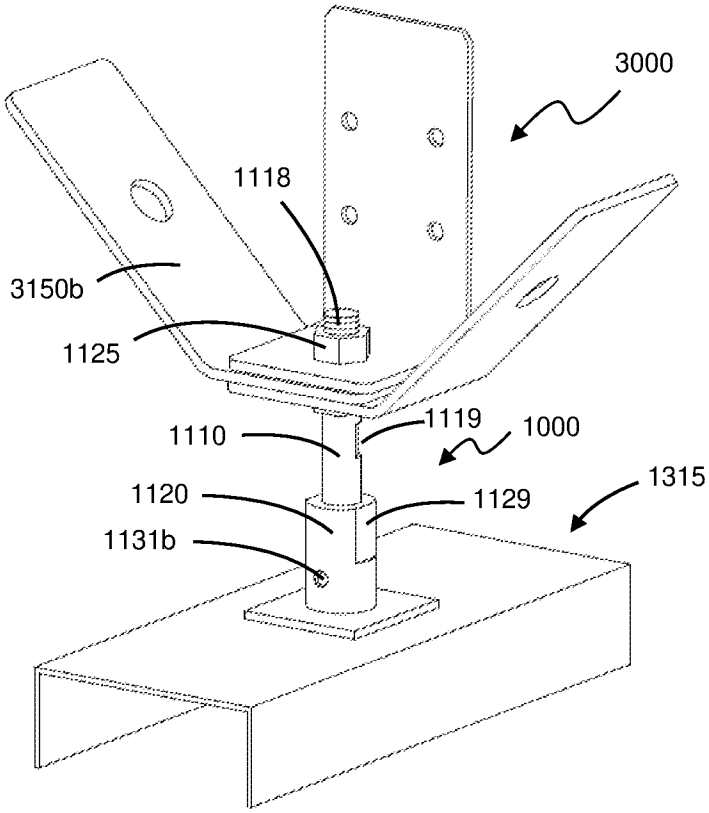
FIG. 11 is a isometric view of another form of partition wall bracket according to the invention, in which the bracket comprises a lateral support bracket having three rigid, angled connectors, two or which extend from the bracket at an angle of 45 degrees and one of which extends from the bracket at an angle of about 90 degrees.
Figure 10:
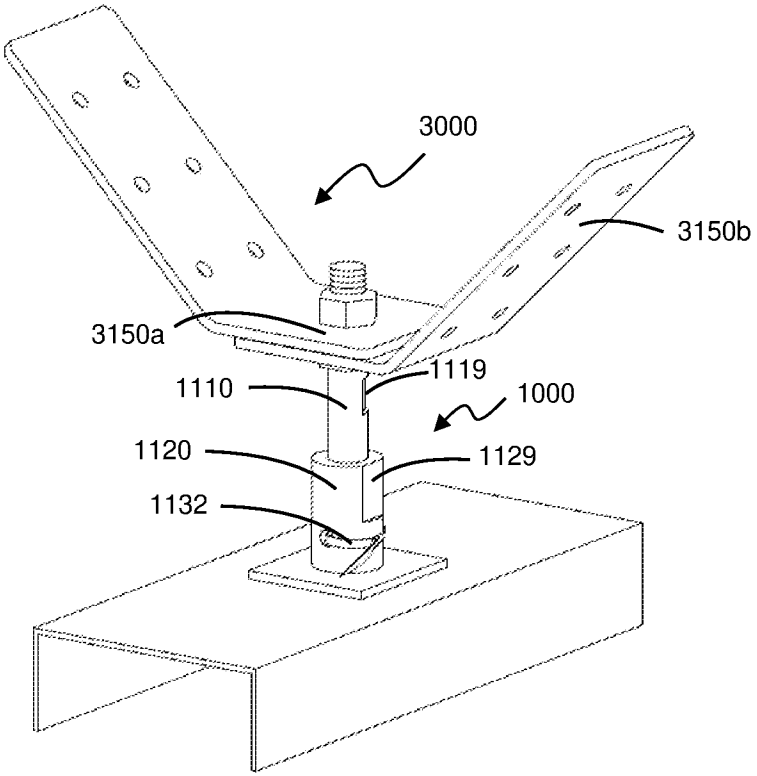
FIG. 10 is a isometric view of another form of partition wall bracket according to the invention, in which the bracket comprises a locking member in the form of a tie, and in which gripping portions of the sheath and shaft are visible.
Figure 12:
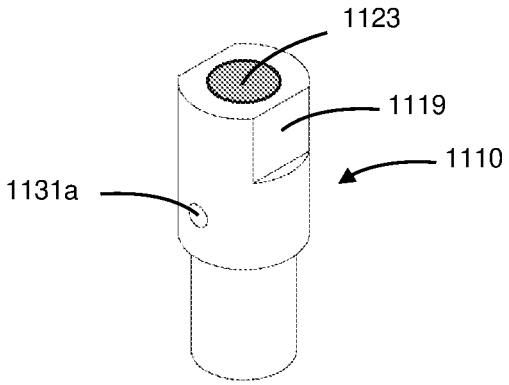
FIG. 12 is an isometric view of one form of sheath that may be used with the bracket of the invention.
Figure 13:
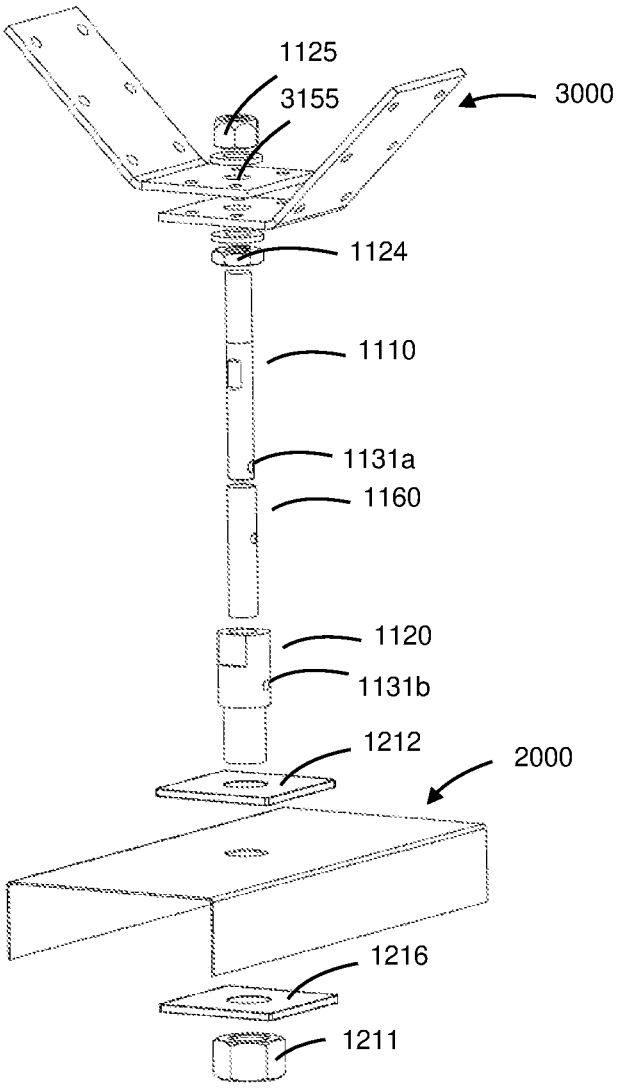
FIG. 13 is an exploded view of one form of bracket assembly in which the partition wall bracket of the invention is configured to attach to a partition wall and to a lateral support bracket.

In the embodiment shown in FIGS. 5, 6, 8 to 11, and 13, the upper structure/lateral support bracket 3100, forms an angle bracket that comprises two or more rigid connectors 3150 for attaching to nominal 45 degree rigid bracing members commonly used in building support structures. Each rigid connector 3150 comprises a horizontal portion 3150*a* with an aperture for attachment to the second attachment system 1220 of the bracket 1000; and an angled portion 3150*b* for fastening to a respective rigid bracing member. The bracket 1000 may attach to a single rigid connector 3150 or to multiple rigid connectors. Where multiple connectors 3150 are present, the horizontal portions 3150*a* of the connectors overlay each other with their apertures concentric such that the threaded end of a shaft 1110 of the body 1100 extends through the apertures in both or all the respective connectors 3150, as shown in FIGS. 10, 11 and 13. This advantageously allows the connectors 3150 to be rotated about the longitudinal axis of the bracket to accommodate and enable connection to bracing members extending in different directions.

Figure 19:
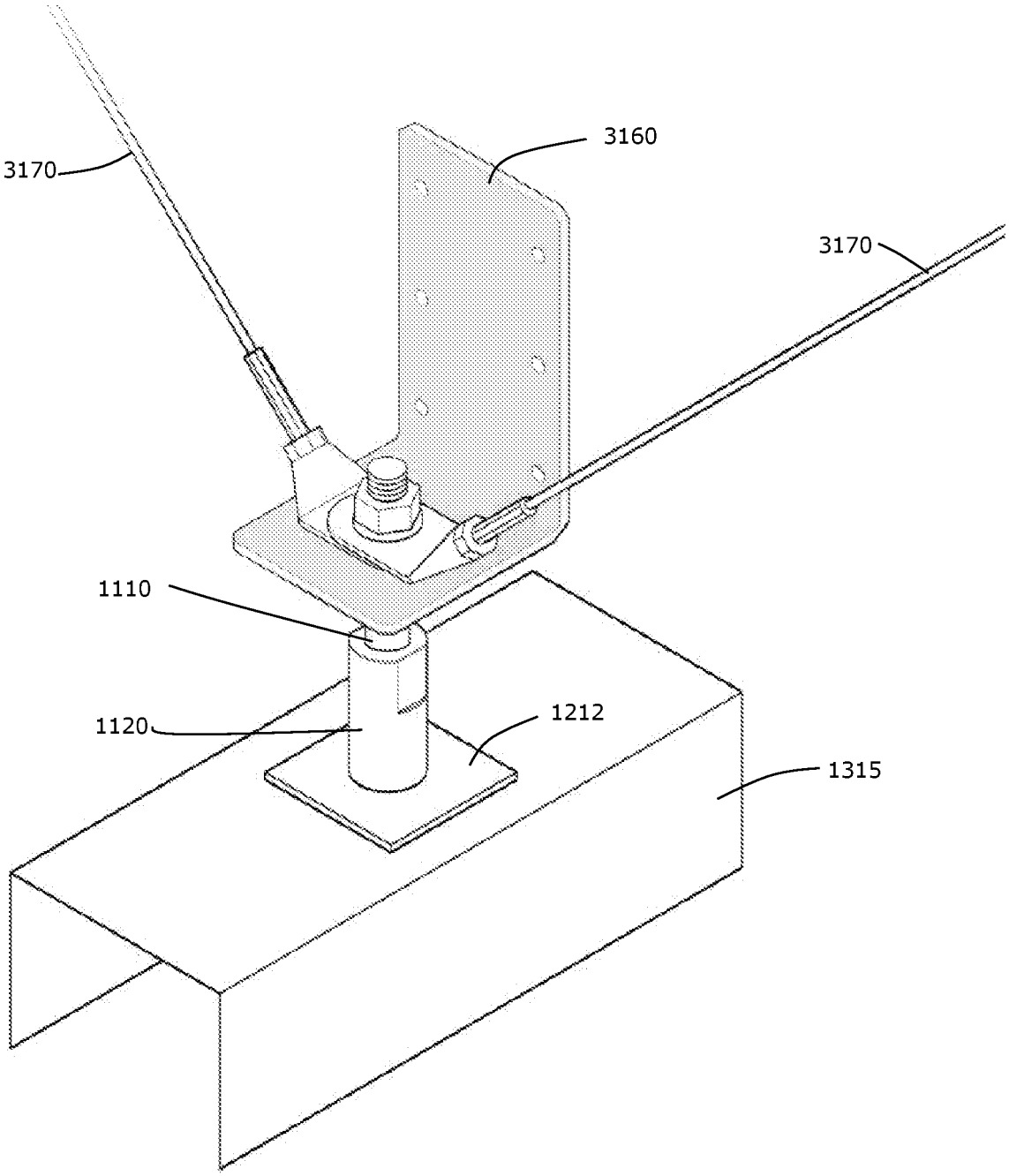
FIG. 19 is a perspective view of another embodiment bracket attached to tension bracing members and also comprising a single L-shaped rigid connector.
Figure 20:
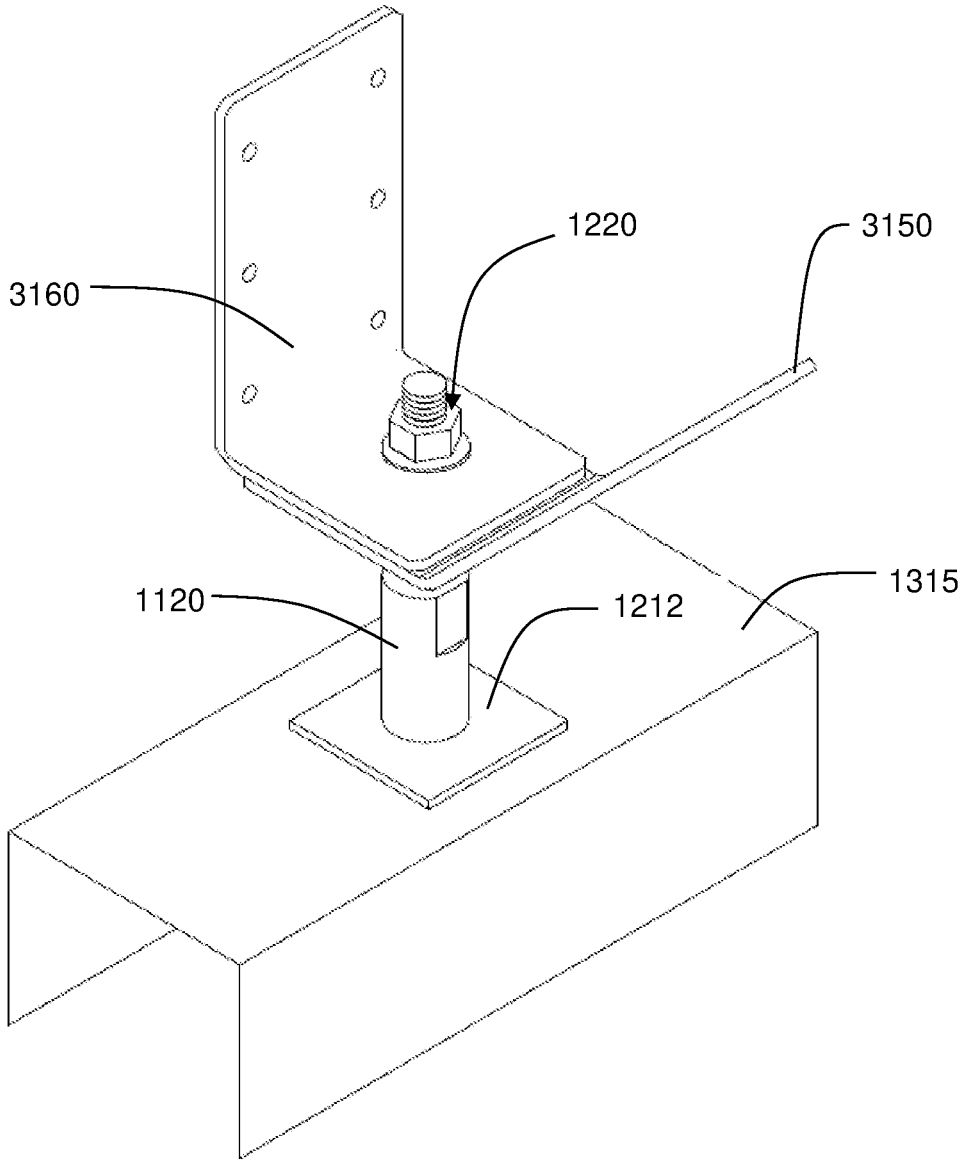
FIG. 20 is a perspective view of a further embodiment bracket attached to an L-shaped rigid connector and a 45 degree bracket.
Figure 21:
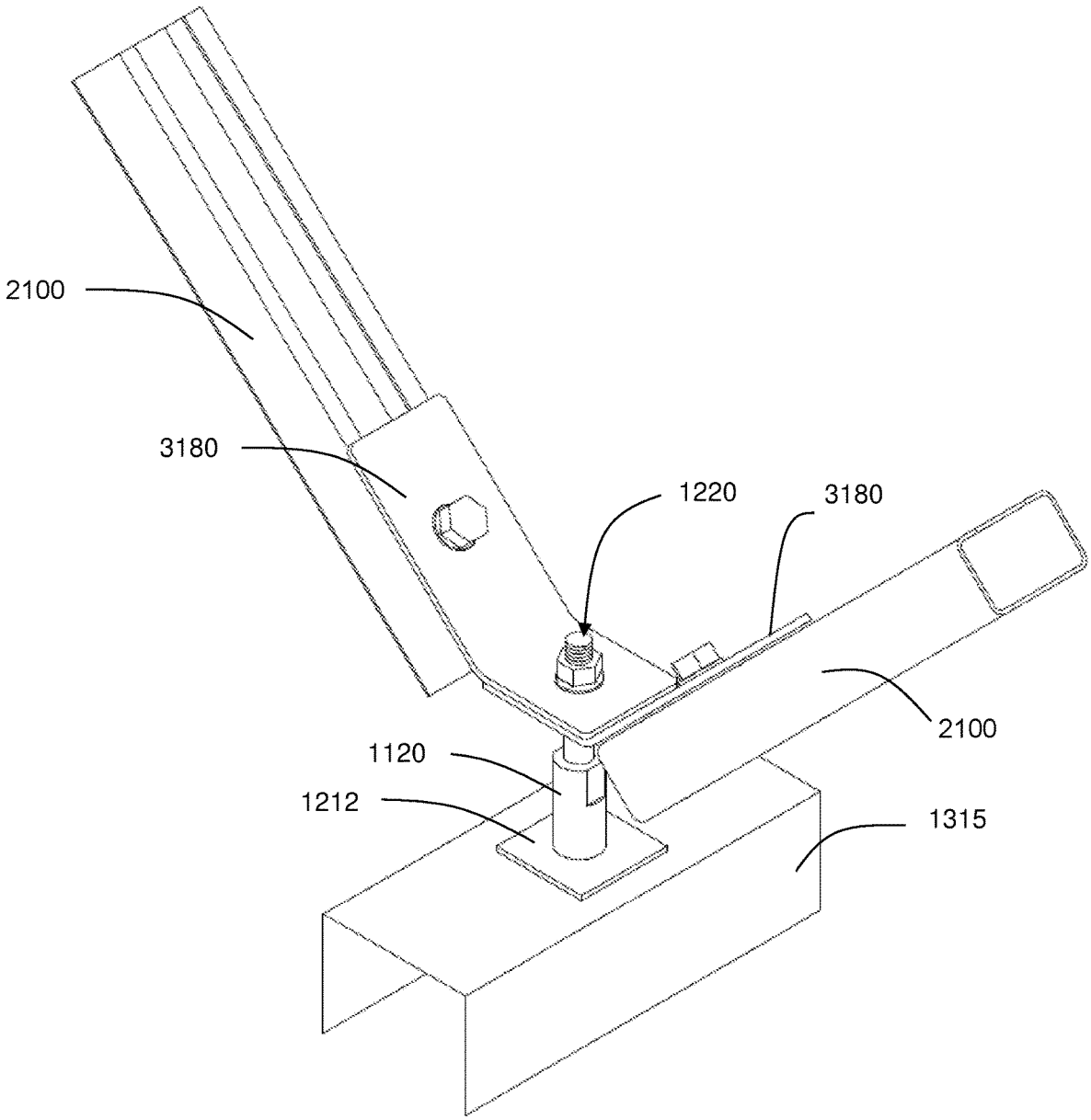
FIG. 21 is a perspective view of yet a further embodiment bracket attached to two 45 degree connector brackets, each having a single bolt to connect to bracing.

In alternative embodiments, the bracket 1000 may attach to an alternative bracing member or members, such as a tensile member connector, or to a bracing member having an angle other than 45 degrees such as a vertical, 90 degree bracing member 3160. FIG. 19 shows an exemplary embodiment bracket attached to two 45 degree tensile (cable) members 3170 and with a 90 degree bracket (L-bracket) 3160 for attaching to a vertical bracing member. It will also be appreciated that further embodiments will have other combinations and types of attachments for securing the bracket to the upper structure, and that the attachments selected will depend on the lateral bracing requirements and constraints relating to the ceiling cavity (plenum space) and the overhead structure. For example, the embodiment shown in FIG. 20 includes an L-shaped (90 degree) bracket and a 45 degree bracket, and FIG. 21 includes two 45 degree brackets having only a single bolt for attaching to angled bracing members. Other embodiments may include other combinations of angled and/or vertical braces.

In some forms, the bracket 1000 may comprise or attach to a lateral support bracket 3100, 3180 comprising one or more rigid connectors 3150 comprising an angle between a horizontal portion 3150*a*, 3185*a* and an angled portion 3150*b*, 3185*b*. The angle of the angled portion may generally correspond with the angle of the bracing member(s) 2100, may otherwise meet the angular orientation required for lateral bracing, or the lateral support bracket(s) 3180 may otherwise attach to the bracing member(s) 2300. For example, as shown in FIG. 11, one or more rigid connectors 3150 may comprise an angled portion 3150*b* that projects from the horizontal portion 3150*a* at about 90° or at any angle, such as between about 35° and 90°, and preferably between 40° and 60° and most preferably at 45°. Where multiple rigid connectors are used, each connector may have generally the same angle between the horizontal 3150*a* portion and the angled portion 3150*b* of the connector 3150, or one or more connectors 3150 may have a different angle between the horizontal portion and the angled portion compared to one or more of the other connectors 3150.

Figure 25:
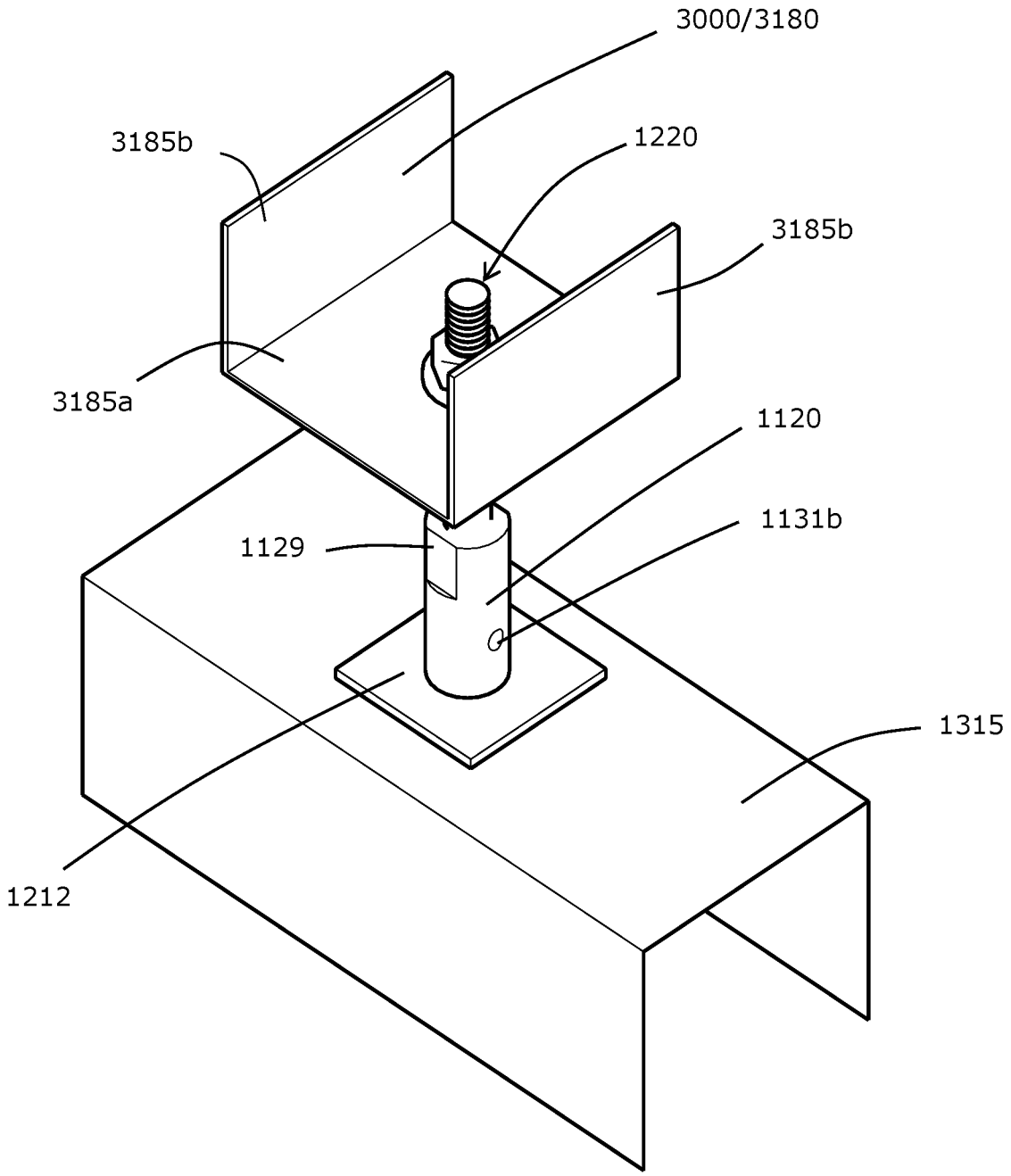
FIG. 25 is a perspective view of the bracket of FIGS. 9 to 14*c* attached to a channel bracket.
Figure 26A:
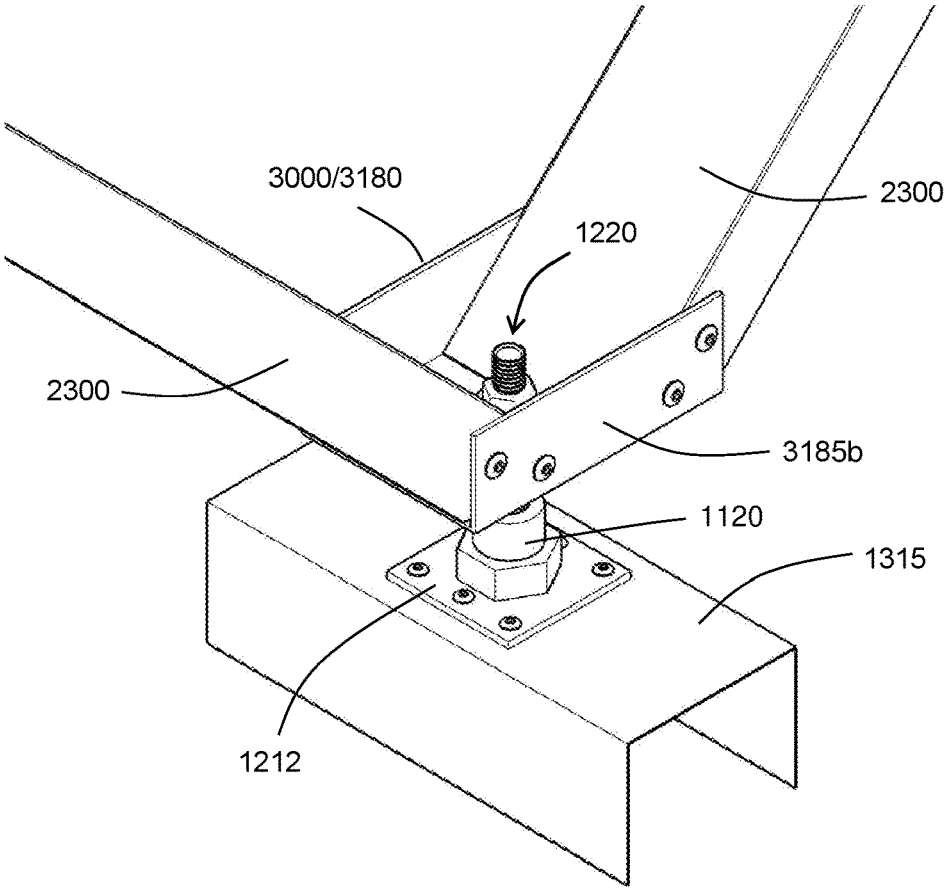
FIGS. 26A and 26B show a further form of the embodiment of FIG. 25, retrofitted to a head track and attached to diagonal bracing, where
Figure 26B:
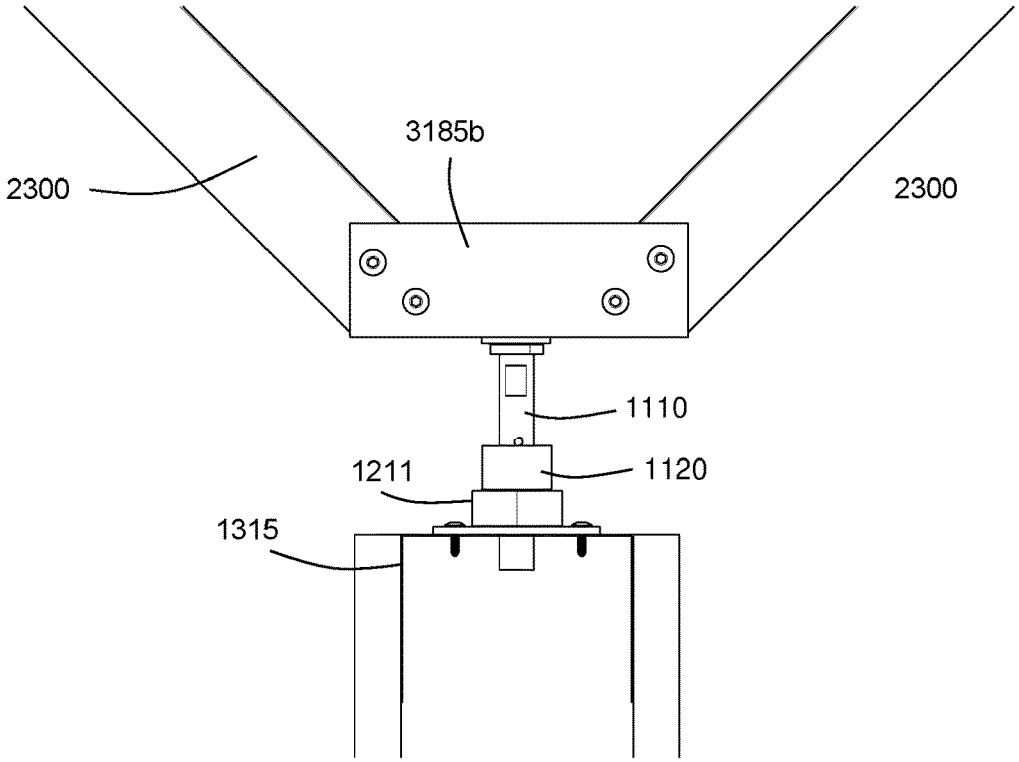

In the embodiments shown in FIGS. 25 and 26, having a channel shaped rigid connector 3180, the bracing members are received between the two angled portions 3185*b* and attached to the angled portions 3185*b*, as shown in FIG. 26, such as by screwing or bolting or otherwise attaching the bracing members 2300 to the two angled portions 3185*b*.

In some forms, the body 1100 of the partition wall bracket 1000 is preferably located between the first 1210 and second 1220 attachment systems. The bracket body 1100 comprises a shaft 1110 and a sheath/sleeve 1120. The sheath 1120 comprises a hollow region 1123 and is configured to receive the shaft 1110 in a sliding arrangement so that the shaft 1110 can move/slide longitudinally relative to the sheath, along at least a portion of the length of the sheath 1120. Preferably, the shaft 1110 comprises an exterior surface, at least a portion of which is generally smooth to allow the shaft to slide freely with respect to the sheath 1120, such as within the sheath 1120. Preferably, the hollow region of the sheath 1120 comprises an interior surface, at least a portion of which is generally smooth to allow the sheath to slide freely with respect to the shaft 1110. In preferred forms, that portion of the shaft 1110 that is configured to slide within the sheath comprises a smooth exterior surface and that portion of the hollow region 1123 of the sheath 1120 that is configured to receive a portion of the shaft comprises a smooth surface to allow for smooth sliding movement to occur between the shaft 1110 and sheath 1120.

The sheath/sleeve 1120 comprises a first end 1121 and an opposing second end 1122. In some forms, the first end 1121 of the sheath is attachable to the first attachment system 1210, which, in the embodiment shown, is configured to directly or indirectly attach to the partition wall 2000. For example, the first attachment system 1210 may attach to a partition wall by attaching to a head track 1310 of the partition wall 2000, or alternatively by attaching directly to a wall stud. The second end 1122 of the sheath 1120 comprises an opening to a hollow region 1123 within the sheath. The hollow region 1123 is configured to receive a portion of the shaft 1110. Optionally, the first end 1121 of the sheath 1120 also comprises an opening and the hollow region 1123 extends between the first and second ends 1121, 1122 to provide the sheath 1120 with a hollow, tubular, sleeve-like configuration.

In one form, the sheath 1120 comprises a stabilising portion 1127 and an attachment portion 1128. The attachment portion 1128 is located at or near the first end 1121 of the sheath 1120 and is adapted to engage with the first attachment system 1210. The stabilising portion 1127 is located at the second end 1122 of the sheath and is configured to surround a portion of the shaft 1110.

Figure 28:
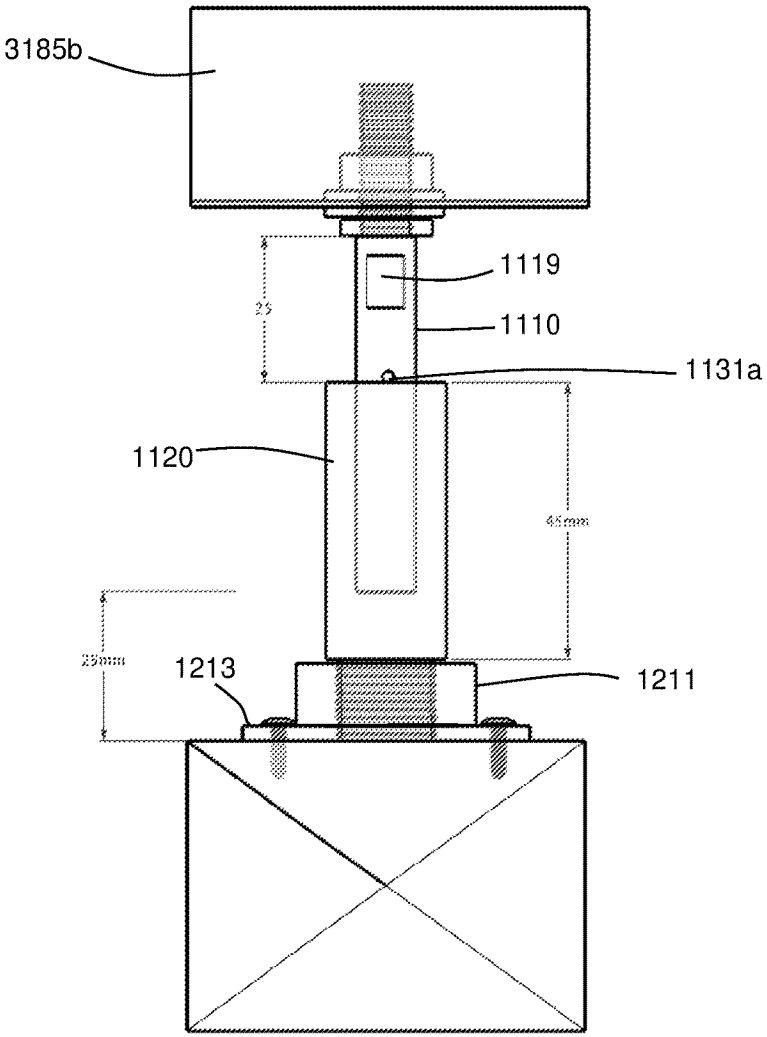
FIG. 28 is a side view of an alternative embodiment bracket mounted to a timber member and having a sheath with a length of 58 mm (about 2.28 inches).
Figure 27:
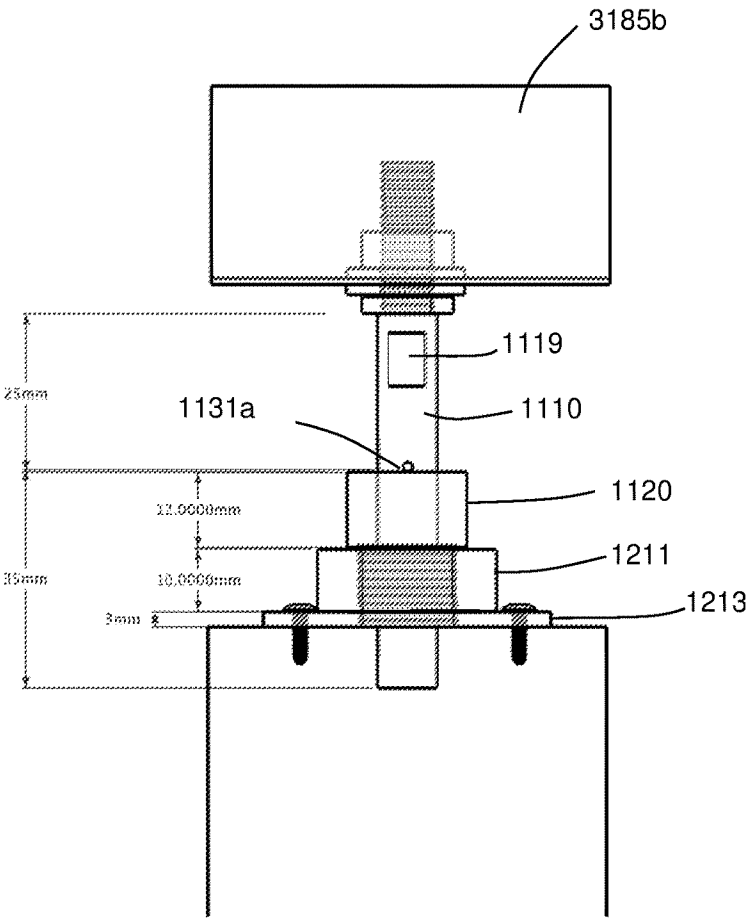
FIG. 27 is a side view of one embodiment bracket retrofitted to a head track and having a sheath with a length of 25 mm (about 0.98 inches). In other forms, the bracket of FIG. 27 may be fitted to a head track in the first instance, rather than being retrofitted.

The sheath 1120 may be of any suitable shape. However, in some forms, the sheath is elongate. In a particularly preferred form, the sheath 1120 is a cylindrical shape, as shown in FIG. 1. The hollow interior region 1123 of the sheath may also be of any suitable regular or irregular shape. Preferably, the hollow region 1123 of the sheath also has a generally cylindrical interior surface to provide the hollow region 1123 with a circular lateral cross-section. In other forms, the hollow region 1123 may comprise an elliptical lateral cross-section or a quadrilateral lateral cross-section, preferably with rounded corners. Regardless, of the shape of the sheath 1120, in some forms the lateral cross-section of the hollow region 1123 is of generally consistent shape and dimensions along the length of the hollow region. In some forms, the dimensions of the opening to the hollow region 1123 at the second end 1122 of the sheath are larger than the lateral cross-section of any other area of the hollow region. Preferably, the sheath 1120 is between about 20 mm (about 0.79 inches) to about 60 mm (about 2.36 inches) long or between about 20 mm (about 0.79 inches) to about 70 mm (about 2.75 inches) long, such as about 25 mm (about 0.98 inches) to about 50 mm (about 1.97 inches) long, or about 30 mm (about 1.18 inches) to about 70 mm (about 2.75 inches) long, or about 50 mm (about 1.97 inches) to about 70 mm long (about 2.75 inches). FIGS. 27 and 28 show two embodiments of brackets having different sheath lengths. In the embodiment of FIG. 27 the sheath is 25 mm (about 0.98 inches) long and consists of a 12 mm (about 0.47 inches) stabilising portion and a 13 mm (about 0.51 inches) attachment portion. In contrast, in the embodiment of FIG. 28 the sheath is 58 mm (about 2.28 inches) long and consists of a 45 mm (about 1.77 inches) stabilising portion and a 13 mm (about 0.51 inches) attachment portion.

The shaft 1110 may comprise an elongate member, such as a rod, having a first end 1111 and a second end 1112. The shaft 1110 comprises an exterior surface that is preferably shaped to correspond with the shape of the interior surface of the hollow region 1123 of the sheath 1120. The shaft 1110 is configured to slide freely within the sheath, along the length of the hollow region 1123. Preferably, the exterior cross-sectional dimensions of the shaft, such as the shaft diameter or width are only slightly smaller than the cross-sectional dimensions of the hollow interior of the sheath so that the shaft and the sheath maintain a sliding relationship, but a minimal gap is provided between the shaft and sheath. For example, the gap may be between 0.2 mm (about 0.008 inches) to 3 mm (about 0.12 inches) and is preferably between 0.3 mm (about 0.012 inches) and 1 mm (about 0.04 inches), such as 0.5 mm (about 0.02 inches). By minimising the size of the gap between the shaft and the sheath as much as possible, the risk of dust and small particles becoming stuck between the shaft and sheath is also minimised and a strong connection providing lateral restraint is maintained. Preferably, the shaft 1110 is a generally cylindrical shape having a circular lateral cross-section. Preferably, the hollow region 1123 of the sheath 1120 also comprises a circular lateral cross-section. In some forms, the shaft is about 10 mm (about 0.39 inches) in diameter and the diameter of the hollow portion of the sheath is about 11.5 mm (about 0.45 inches). However, in other forms, the shape of the shaft 1110 (defined by the exterior surface of the shaft 1110) may differ to the shape of the hollow region 1123 (defined by the interior surface of the sheath 1120), but may be dimensioned to be sufficiently smaller than the sheath 1120 so as to move/slide freely along the length of the hollow region 1123. In any configuration, it is important that the lateral cross-section of at least a portion of the shaft 1110 is smaller than the lateral cross-section of the sheath 1120 to allow the shaft to slide freely within the sheath.

In some forms, the first end 1111 of the shaft 1110 and at least a portion of the shaft length is received within the hollow region 1123 of the sheath 1120 so that a portion of the shaft 1110, including the second end 1112 of the shaft, extends from the sheath 1120.

Preferably, the shaft 1110 and the sheath 1120 are concentrically aligned such that a longitudinal axis passes along a centreline of both the shaft 1110 and sheath 1120. The longitudinal axis may also form the longitudinal axis of the bracket body 1100. The shaft 1110 is able to move along the longitudinal axis within the sheath 1120. In one form, the shaft 1110 is between about 50 mm (about 1.97 inches) to about 150 mm (about 5.90 inches) long, such as between about 70 mm (about 2.75 inches) to about 120 mm (about 4.72 inches) long. Preferably, the shaft 1110 is able to move longitudinally between about +/−5 mm (about +/−0.20 inches) to about +/−75 mm (about +/−2.95 inches) within the sheath 1120, such as between about +/−50 mm (about +/−1.97 inches) to about +/−75 mm (about +/−2.95 inches). These measurements are nominal only and can be changed to meet individual site requirements. In other words, as the bracket automatically adjusts under compression or expansion, the distance between the one end of the shaft and the sheath will vary to accommodate the movement between the overhead structure and the partition wall. In effect, the shaft is able to float freely within the sheath. By allowing automatic, uninhibited vertical movement of the bracket to accommodate vertical compression and expansion actions/forces, the bracket of the invention substantially precludes the transfer of the compression and expansion actions/forces onto the partition wall while the bracket is at a length between its adjustment limits. It is expected that a bracket of the invention will regularly self-adjust as the building within which it is installed undergoes movement.

Preferably, the shaft comprises an extension portion 1117, for being at least partially received within the stabilising portion 1127 of the sheath, and an attachment portion 1118 for attaching to an upper structure 3000. The stabilising portion of the sheath 1120 surrounds the extension portion of the shaft 1110 and helps ensure that the longitudinal axis of the shaft 1110 remains generally aligned with the longitudinal axis of the sheath 1120 as the shaft 1110 moves within the sheath 1120.

The material of the bracket components is selected depending on the loads which the bracket is required to operate under without failure, but will typically be a metal. In preferred embodiments of the invention the shaft and/or the sheath comprise stainless steel, preferably 304 stainless steel, to provide improved loading/ductile capacities compared to common carbon steels. The first and second attachment systems may also comprise stainless steel.

In some embodiments, as shown in FIG. 13, the bracket 1000 may further comprise an acoustic barrier comprising a lining sleeve 1160. In one form, the lining sleeve 1160 is positioned within the hollow region 1123 of the sheath 1120. The lining sleeve 1160 fits closely against the internal surface of the hollow region 1123, such that the lining sleeve 1160 receives at least part of the shaft portion 1110 positioned within the sheath hollow 1123. The lining sleeve 1160 preferably extends substantially along the length of the hollow 1123 or along a major part of the length of the hollow 1123, but alternatively may only extend along a portion of the length of the hollow. Preferably, the lining sleeve is a hollow member with a shape corresponding to the cross sectional shape of the sheath hollow 1123, for example, the lining sleeve 1160 is a cylindrical, tubular member in the embodiment shown. Alternatively, the lining sleeve may be formed from two or more pieces, for example two semi-cylindrical members, and/or, the lining sleeve may be a C-shaped member that is adjustable to fit within the sheath hollow 1123.

In the embodiment shown, the lining sleeve 1160 is substantially fixed relative to the sheath 1120, for example through friction where the lining sleeve is assembled to the sheath 1120 by way of a press fit or other interference or tight fit. Alternatively, the lining sleeve may be adhered, mechanically fastened to the sheath 1120, or otherwise attached.

As the shaft 1110 moves longitudinally relative to the sheath 1120, the shaft 1110 is in sliding contact with the lining sleeve and bears against an internal surface of the lining sleeve. The lining sleeve 1160 advantageously prevents or minimises the surface of the shaft 1110 rubbing or knocking against a surface of the sheath and therefore minimises noise created by the shaft and sheath rubbing against each other.

In alternative embodiments, a lining sleeve 1162 may instead be provided on the extension portion 1117 of the shaft 1111 and fixed relative to the shaft 1111 to move in tandem with the shaft 1111 and relative to the sheath 1120. FIGS. 15 to 17*c* show an embodiment 1001 where the lining sleeve 1162 is secured to the shaft 1111. The lining sleeve 1162 is substantially fixed relative to the shaft 1111, for example through friction where the lining sleeve is assembled to the shaft 1111, by way of a press fit or other interference or tight fit. As illustrated in FIGS. 17*a* to 17*c*, as the shaft 1111 moves longitudinally relative to the sheath 1120, the lining sleeve 1162 moves in tandem with the shaft 1111, bearing against an internal surface of the sheath 1120 to prevent or minimise the surface of the shaft 1111 rubbing or knocking against a surface of the sheath 1120.

The lining sleeve 1160, 1162 preferably comprises a low friction, resilient material such as a nylon or plastic, thereby reducing noise associated with relative movement of two metal surfaces contacting each other. The lining sleeve may also reduce wear to the shaft 1110, 1111 and the sheath 1120, reduce heat generation, and reduce resistance to relative longitudinal motion.

As a further alternative, rather than a distinct component, the lining sleeve 1160, 1162 may be integral with the sheath 1120 or the shaft 1110, for example, created by applying a coating to the outer surface of the extension portion of the shaft 1110, 1111 or to the surface of the sheath hollow 1123. In one form, the lining sleeve 1160, 1162 may be formed by coating the interior of the sheath 1120 and/or the exterior of at least a portion of the shaft 1110/1111 with plastic, rubber or nylon. In some forms, the lining sleeve is about 0.5 mm (about 0.02 inches) thick, the shaft diameter is about 10 mm (about 0.39 inches) and the diameter of the hollow region within the sheath is about 11.5 mm (about 0.45 inches).

Optionally the bracket 1000 may comprise a biasing member such as a spring to bias the sheath 1120 and the shaft 1110 to a desired position, for example a neutral position from where the bracket 1000 can extend or retract. The biasing member may be positioned within the hollow 1123 of the sheath and may assist to move the bracket 1000 back towards the neutral position after a vertical displacement, or may primarily be to stabilise the bracket 1000 during installation. FIG. 14*a* shows the bracket in a neutral position.

The sheath 1120, and therefore the body 1100, of the bracket 1000 may be configured to attach to the first attachment system 1210 in many different ways. In one form, as shown in FIGS. 1 to 3 and 13, the attachment portion 1128 of the sheath 1120 comprises a threaded outer surface and is configured to extend through an aperture formed in the central portion 1317 of a u-shaped head track 1315. The first attachment system 1210 comprises a first attachment member 1211 comprising a nut having a threaded interior surface that engages with the threaded exterior of the attachment portion 1128 of the sheath. Optionally, a washer 1216 is provided between the nut 1211 and the head track 1315 and a washer 1212 is provided between the head track 1310 and the stabilising portion 1127.

Figure 4:
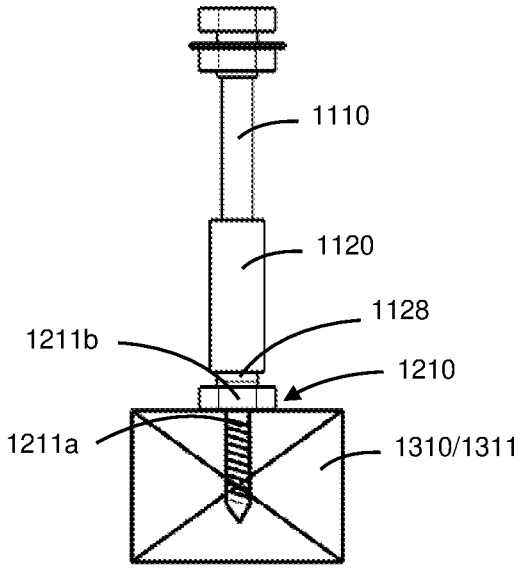
FIG. 4 is an assembled side view of the bracket of FIG. 1 when attached to a timber head track of a partition wall.

In yet another form, as shown in FIG. 4, the bracket 1000 may be configured to attach to a timber head track 1311 or the bracket 1000 may attach directly to the top of a partition wall 2000 or directly to a wall stud, such as a timber wall stud. In either form, the first attachment system 1210 may comprise a first attachment member 1211 comprising a screw or bolt 1211*a* that is screwed into the upper surface of the head track 1311 or wall 2000. The first attachment system 1210 also comprises a nut 1211*b* that may be integrally formed with the screw or bolt 1211*a*, such as by forming the head of the screw or bolt. Alternatively, the nut 1211*b* may be attached to the screw or bolt 1211*a*. The nut 1211*b* comprises an aperture having a threaded interior for receiving and engaging with the threaded exterior of the attachment portion 1128 of the sheath 1120. In this arrangement, the first end 1121 of the sheath 1120 can simply be screwed into the nut 1211*b* to attach the bracket 1000 to the partition wall 2000. In an alternative form, the attachment portion 1128 of the sheath 1120 may comprise a threaded interior for engaging with an attachment member of the first attachment system 1210 that comprises a head, as described above, but that comprises a threaded exterior portion.

Figures 18A, 18B:
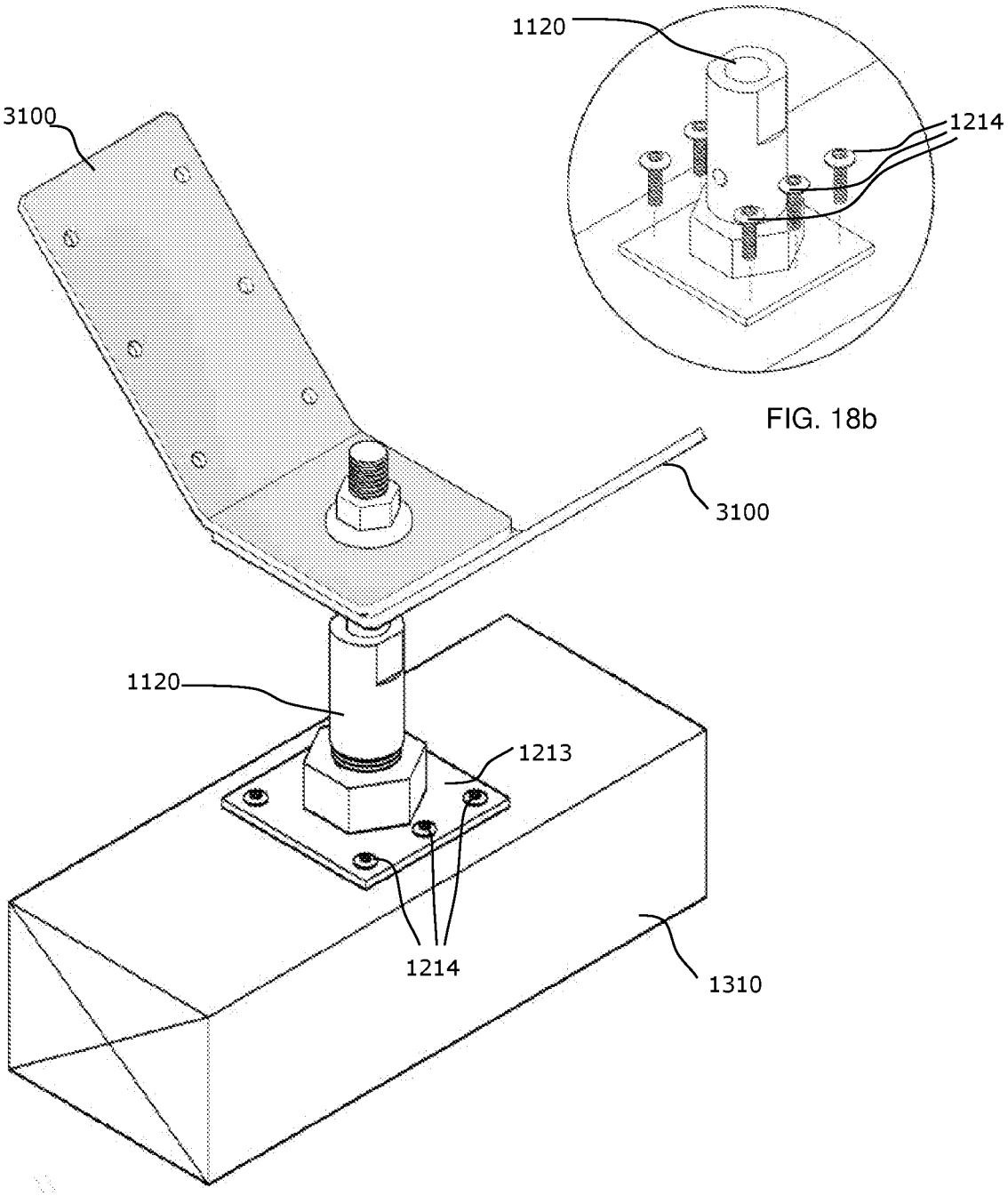
FIGS. 18*a* and 18*b* show a further alternative embodiment bracket for retrofitting the bracket to an existing partition wall, or to a timber beam, where

In yet another form, such as the embodiment of FIGS. 18*a* and 18*b*, the first attachment system comprises an intermediate element, such as a plate 1213. The intermediate element attaches to the first end of the sheath 1120. In the embodiment shown, the first end of the sheath 1120 is threaded and screws into a nut that is fixed to the intermediate element 1213. However, it will be appreciated that the sheath may be otherwise secured to the intermediate element or may be integrally formed with the intermediate element. The intermediate element also comprises a plurality of screw holes through which screws 1214 may be inserted to screw the plate 1213 (or other intermediate element) to the head track, beam 1310 (such as a horizontal timber member), or partition wall 2000.

In another form, the attachment portion 1128 is located at the first end 1121 of the sheath 1120 and comprises an opening, at the first end 1121, having a threaded interior for receiving an attachment member 1211 comprising a screw or threaded bolt. In this form the attachment member may be attached to the partition wall or head track, such as by extending through an aperture in the central portion 1317 of a u-shaped head track 1315. The threaded end of the attachment member may engage with the threaded portion at the first end of the sheath 1120 to attach the sheath to the partition wall 2000. Optionally, a washer is provided between the head of the attachment member/screw/bolt and the central portion 1317 of the head track 1315. A washer 1212 may also be provided between the head track 1315 and the stabilising portion 1127. The washers 1212, 1216 sandwiching the head track (FIG. 13) are preferably significantly larger than the size of the opening or nut 1211. This ensures any vertical loading applied through the bracket when the bracket is at its maximum compression (and/or in some embodiments, maximum extension) is transferred to the head track over a wider area than would be the case if only small washers or no washers were used. This advantageously increases the force required to separate the bracket from the head track. In the embodiments of FIGS. 8 to 13, 15 and 17*a* to 17*c*, the washer 1212 has a width that is at least about 1.8 times the outer diameter of the sheath at the base of the sheath 1120. Preferably the washer 1212 has a width that is more than about 2 times the outer diameter of the sheath Referring to FIGS. 9 to 11 and 15 to 17*c*, the sheath 1120 may comprise opposing gripping portions, such as cut-outs or other flattened surfaces 1129 to facilitate gripping of the sheath by a tool such as a spanner during installation, to allow the nut 1211 of the first attachment system to be tightened by turning the nut 1211 relative to the sheath 1120.

Figure 5A:
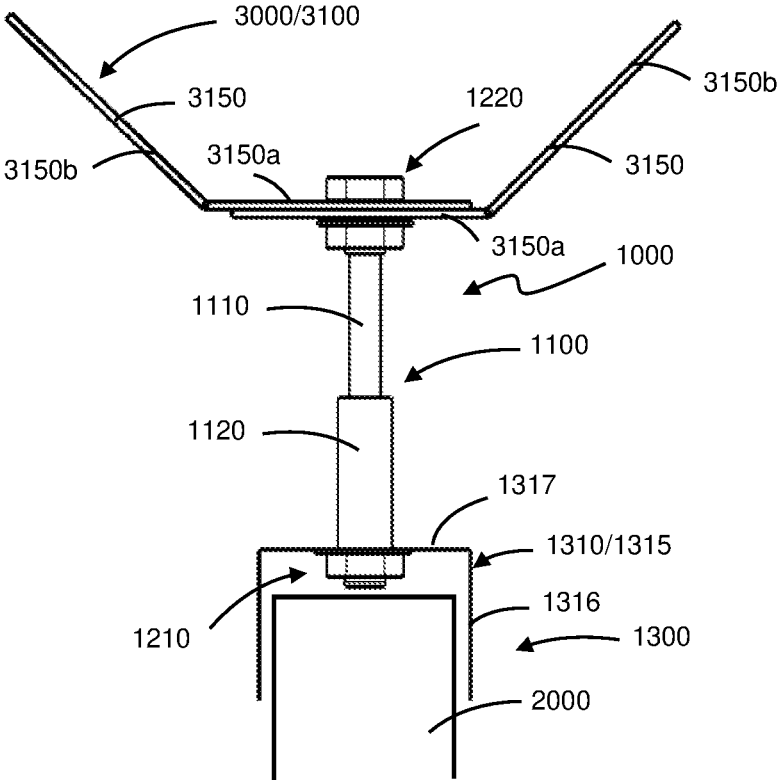
FIGS. 5*a* and 5*b* are assembled side views of the bracket of FIG. 1 when attached to a u-shaped head track of a partition wall and an upper structure comprising a lateral support bracket.
Figure 5B:
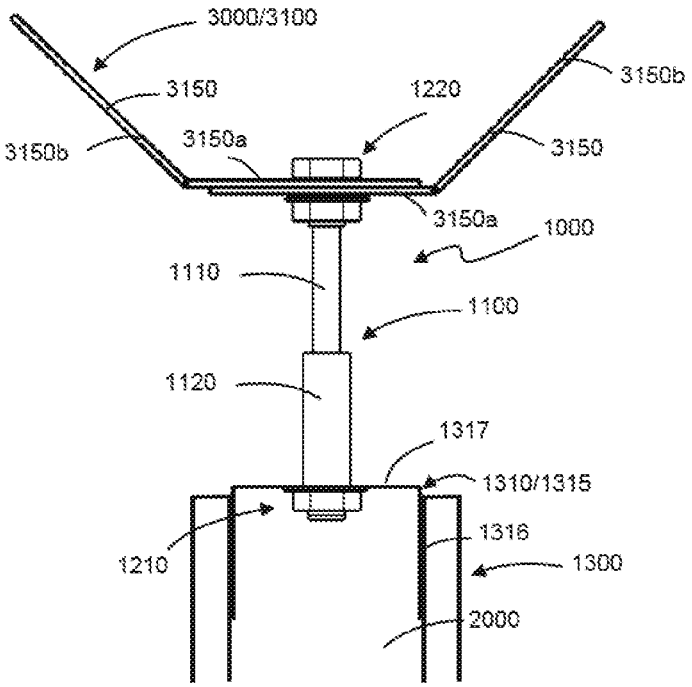
Figure 6:
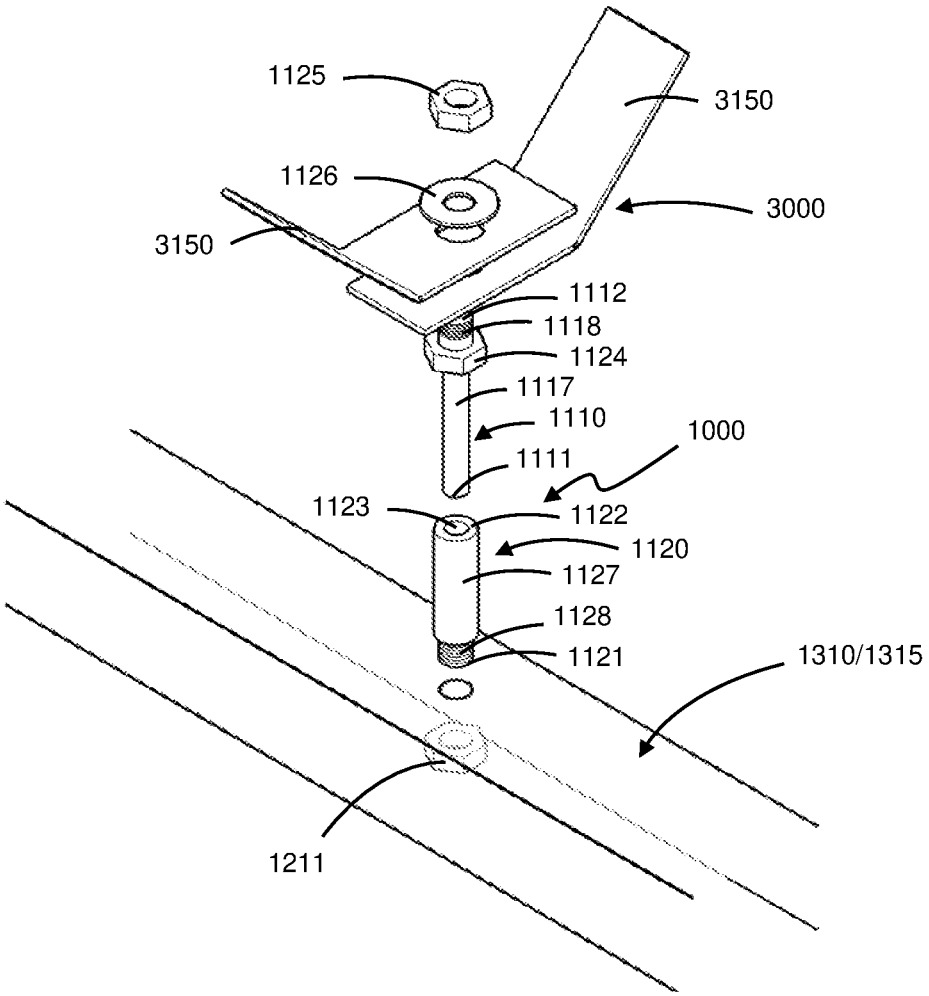
FIG. 6 is an exploded view of the assembled bracket arrangement of FIG. 5.

The bracket 1000 of the invention may also be attached to an upper structure that is located above the ceiling when the bracket 1000 is in use, such as a lateral support bracket 3100 or a beam or brace. FIGS. 1, 5 and 6 show one form of bracket 1000 comprising a shaft 1110 comprising an extension portion 1117 and an attachment portion 1118. The extension portion 1117 is configured to move within the hollow region 1123 of the sheath 1120, such as within the stabilising portion 1127 of the sheath 1120. The attachment portion 1118 of the shaft is located at or near the second end 1112 of the shaft 1110 and is configured to engage with the second attachment system 1220 to attach the bracket 1000 to an upper structure 3000/lateral support bracket 3100.

Figure 2:
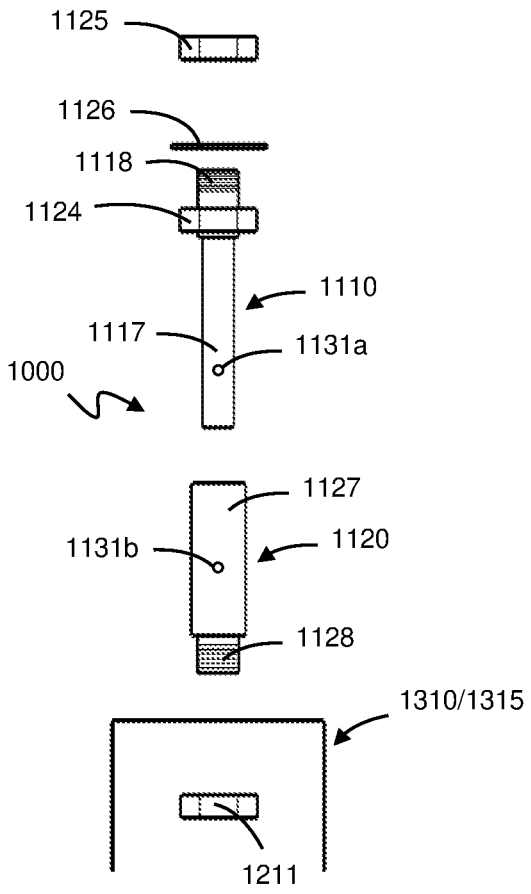
FIG. 2 is an exploded side view of the bracket of FIG. 1, being attached to a u-shaped head track of a partition wall.
Figure 3:
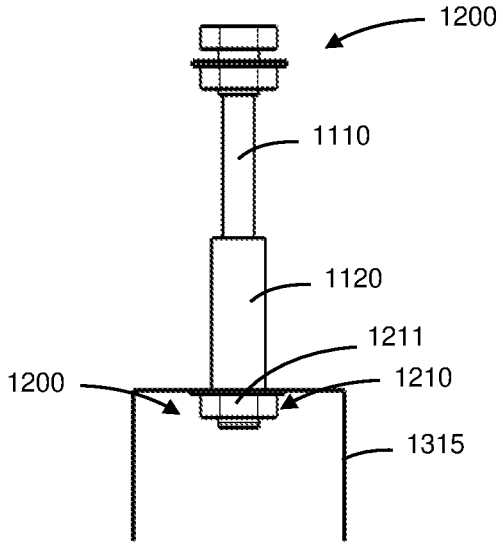
FIG. 3 is an assembled side view of the bracket of FIG. 1 when attached to a u-shaped head track of a partition wall.

The second attachment system 1220 may be any suitable system for attaching the shaft 1110 to an upper structure 3000, such as to a lateral support bracket/bracing bracket 3100. In one form, the second attachment system 1220 forms a clamping arrangement that clamps onto a portion of an upper structure 3000, such as a beam or a lateral support bracket 3100, 3101 or brace, which itself is then attached to the building structure via framing within the ceiling cavity to support the partition wall 2000 laterally. In this form, the second attachment system 1220 comprises first and second clamping members 1224, 1225 for clamping against opposing sides of the upper structure 3000. Where the upper structure is a lateral support bracket 3100 comprising one or more rigid connectors 3150, the clamping member 1225 may be configured to clamp against the top surface of horizontal portion 3150*a*, 3185*a* of the upper most rigid connector and the clamping member 1224 may be configured to clamp against the bottom surface of the horizontal portion 3150*a*, 3185*a* of the lowermost rigid connector, as shown in FIG. 13. Optionally, a washer 1226 may be located between the upper structure and the second clamping member 1225. For example, as shown in FIGS. 2, 5 and 6, a first or lower region of the attachment portion 1118 of the shaft 1110 may be attached to a first clamping member 1224, such as a first nut. A second or upper region of the attachment portion 1118 of the shaft may be attached to a second clamping member 1225, such as a second nut. An aperture may be formed in the upper structure 3000. For example, rigid connectors of a lateral support bracket 3100, 3180 may comprise an aperture 3155 in the horizontal portion 3150*a*, 3185*a* for engagement with the second attachment system 1220 of the partition wall bracket 1000, as shown in FIG. 13. In this form, the second clamping member 1225 may be removed from the shaft 1110 and the partition wall bracket 1000 may be positioned so that the first end 1111 of the shaft 1110 and therefore the attachment portion 1118 is pushed through the aperture until the first clamping member 1124 abuts the upper structure 3000. The second clamping member 1125 is then attached to the attachment portion 1118 of the shaft to clamp the upper structure 3000 between the first and second clamping members 1124, 1125.

Preferably, the attachment portion 1118 of the shaft has a threaded exterior and the first and second clamping members 1124, 1125 comprise nuts having a threaded interior region for engaging with the threaded exterior of the shaft 1110. In this way, the nuts 1124, 1125 can be screwed against the upper structure 3000 to tighten the clamping force and the nuts 1124, 1125 can be unscrewed to lessen the clamping force so that the bracket 1000 can be removed. The nut 1225 preferably has an integral locking mechanism such as a nylon-insert lock nut, polymer-insert lock nut, or elastic stop nut, with a nylon collar insert that resists turning.

Referring to FIGS. 8 to 12 and 15 to 17*c*, the shaft 1110, 1111 may comprise opposing gripping portions, such as cut-outs or other flattened surfaces 1119 to facilitate gripping of the shaft by a tool such as a spanner during installation, to allow the nuts 1124, 1125 to be tightened by turning each nut relative to the shaft 1110.

In another form, the attachment portion 1118 of the shaft 1110 is located at the second end 1112 of the shaft and comprises a threaded aperture formed in the second end 1112 of the shaft and extending along a portion of the length of the shaft 1110. In this arrangement, the bracket 1000 may be positioned so that the second end 1112 of the shaft abuts the upper structure 3000 and the threaded aperture of the shaft 1110 aligns with an aperture formed in the upper structure 3000. The second attachment system 1220 comprises a first attachment member comprising a threaded screw or bolt, which can be pushed through the aperture of the upper structure 3000 from the opposite side so that the screw or bolt extends through the upper structure 3000 and then engages with the threaded interior of the shaft 1110 to attach the bracket 1000 to the upper structure 3000.

The extension portion 1117 of the shaft 1110 is preferably longer than the stabilising portion 1127 of the sheath 1120 to prevent the second attachment system 1220 from contacting the second end 1122 of the sheath when the shaft 1110 moves within the sheath 1120. Preferably, the overall length of the shaft 1110 is longer than the overall length of the sheath 1120.

When installing the bracket 1000, it may be useful to hold the shaft 1110 and the sheath 1120 in position relative to each other so that the bracket 1000 retains a constant length during installation and the partition wall 2000 can be accurately aligned. Therefore, in one form, the bracket may comprise a locking system to lock the shaft 1110 and sheath 1120 together or at least in position relative to each other. In this form, the shaft 1110 and/or the sheath 1120 may comprise a lock receiving aperture 1131*a*, 1131*b*. For example, at least one lock receiving aperture 1131*a* may be formed in the exterior side wall of the shaft 1110. Preferably, the lock receiving aperture 1131*a* extends through the shaft 1110 to form an aperture on the opposing side or surface of the shaft 1110. At least one lock receiving aperture 1131*b* may also be formed in a side wall of the sheath 1120 so that the aperture 1131*b* extends between the exterior side surface of the sheath to the interior surface of the hollow region 1123 within the sheath 1120. The lock receiving aperture 1131*b* of the sheath is positioned to align with the lock receiving aperture 1131*a* of the shaft when the extension portion 1117 of the shaft 1110 is located at the neutral position. The neutral position is where the bracket 1000 can extend or retract in generally equal amounts or as specified by the project-specific design. The locking mechanism is primarily to stabilise the bracket during installation.

Preferably, the sheath 1120 comprises a lock receiving aperture 1131*b* that extends through one side of the sheath 1120, as described above, and continues through the opposing side of the sheath 1120 to form an aperture 1131*b* that extends across the sheath, preferably perpendicular to the longitudinal axis of the sheath 1120.

To lock the shaft 1110 and sheath 1120 together, the shaft 1110 is pushed into the sheath 1120 until it achieves a neutral position, as shown in FIG. 14*a*, at which point the lock receiving aperture 1131*a* of the shaft 1110 aligns with the lock receiving aperture 1131*b* of the sheath 1120. Optionally, the shaft 1110 and or the sheath 1120 may comprise a guide to help position the shaft within the sheath so that the lock receiving apertures 1131*a*, 1131*b* align. For example, a visual guide/marker may be located on the shaft 1110 and at or near the second end 1122 of the sheath 1120 so that by aligning the markers as the shaft 1110 is positioned within the sheath 1120, the lock receiving apertures 1131*a*, 1131*b* also align. Alternatively, the shaft 1110 and/or sheath 1120 may comprise a physical guide to align the receiving apertures 1131*a*, 1131*b* of the two parts 1110, 1120. Any suitable physical guide may be used. For example, the outer surface of the shaft 1110 may comprise a projection or a longitudinal rail that slides within a longitudinal channel provided on the interior wall forming the hollow region of the sheath 1120. Alternatively, the outer surface of the shaft 1110 may comprise a longitudinal channel that slides over a physical projection or a longitudinal rail projecting from the interior wall forming the hollow region of the sheath 1120. In these arrangements, the physical guides are located on the shaft 1110 and sheath 1120 so that the shaft and sheath are positioned relative to each other to align the lock receiving apertures 1131*a*, 1131*b* of the shaft and sheath.

Figure 7:
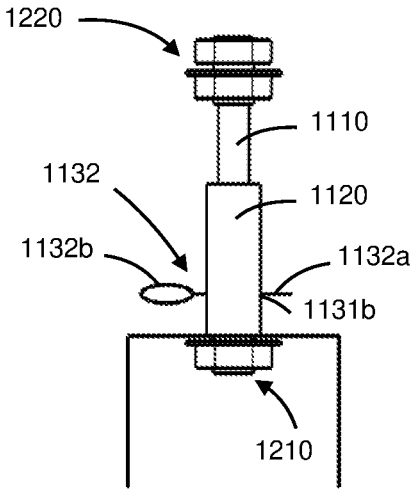
FIG. 7 is an assembled side view of one form of bracket according to the invention, comprising a lock for locking the shaft and sheath of the bracket together.
Figure 8:
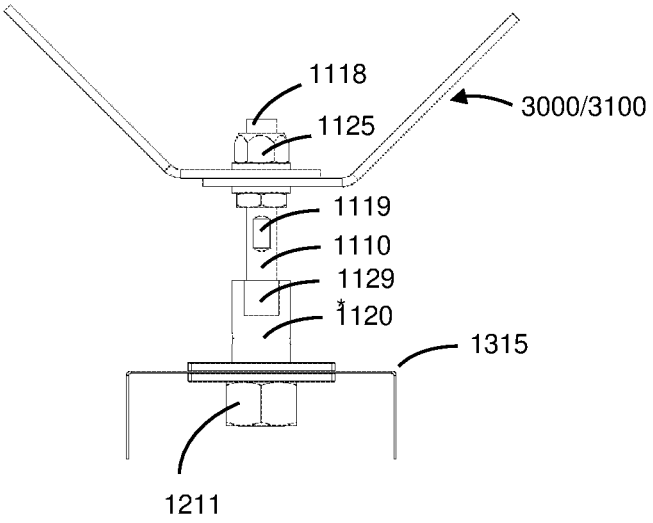
FIG. 8 is an assembled side view of one form of partition wall bracket according to the invention, comprising a lateral support bracket having two rigid, angled connectors extending from the bracket at an angle of about 45 degrees.
Figure 9:
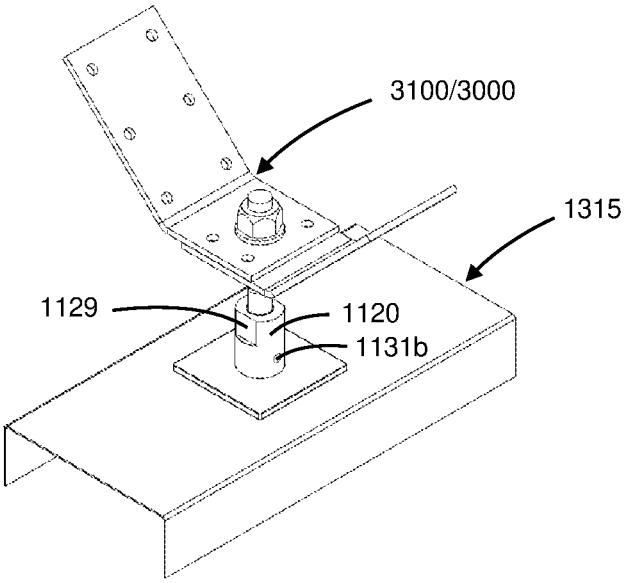
FIG. 9 is an isometric view of the bracket of FIG. 8, in which gripping portions of the sheath can readily be seen.

A locking member 1132, such as a locking pin or tie, is inserted into the aligned lock receiving apertures. The locking member 1132 may comprise any suitable material, but preferably comprises plastic or metal. In the embodiment of FIG. 7, the locking member is a locking pin 1132, comprising a projecting portion 1132*a* and a gripping portion 1132*b*.

The projecting portion 1132*a* of the locking member may be inserted within the aligned apertures 1131*a*, 1131*b* so that a gripping portion 1132*b* projects from the bracket 1000 and can be readily gripped by a user, as shown in FIG. 7. Once the bracket 1000 is installed in a neutral position, a user can grip the locking member by the gripping portion 1132*b* and remove the locking member 1132 from the lock receiving apertures 1131*a*, 1131*b*. The shaft 1110 is then able to move freely within the sheath 1120 so that the bracket 1000 is able to automatically adjust its vertical length.

In an alternative embodiment, as shown in FIG. 10, the locking member 1132 comprises a nylon cable tie ('zip tie'). The cable tie has a flexible strap with a series of ratchet teeth, and a head 1132*b* with a pawl to receive the flexible strap and engage the teeth. The cable tie is inserted through the aligned apertures 1131*a*, 1131*b* and the free end of the strap is inserted through the head 1132 to secure the tie into a loop. The cable tie thereby prevents relative movement of the shaft and sheath under the small loads that would be experienced during installation. The loop form of the tie prevents the locking member 1132 being inadvertently dislodged. Once the bracket 1000 is installed, a user can cut the plastic tie and remove it from the lock receiving apertures 1131*a*, 1131*b* to enable free movement of the shaft 1110 within the sheath 1120. If a user installing the bracket omits to remove the tie, the forces acting on the installed bracket during vertical building displacements will significantly exceed the strength of the tie, causing it to snap without materially impinging the movement of the bracket 1000 and without damaging the bracket.

Alternatively, the locking member may be provided on the shaft or sheath to position the sheath or shaft in a generally neutral position. For example, rather than extending through both of the sheath and the shaft, the locking member 1132 may instead extend through only one of the sheath 1120 or only the shaft 1110, 1111. In one embodiment, apertures are provided in the sheath 1120 towards a base of the sheath, and the locking member extends through these apertures and across the hollow of the sheath. The shaft is then inserted into the hollow until the lower end of the shaft rests on the locking member, in a neutral position of the bracket. The locking member 1132 limits further downwards movement of the shaft, to prevent the bracket compressing and thereby assists with installation. After installation, the locking member 1132 can be removed to allow operation of the bracket.

Figure 16:
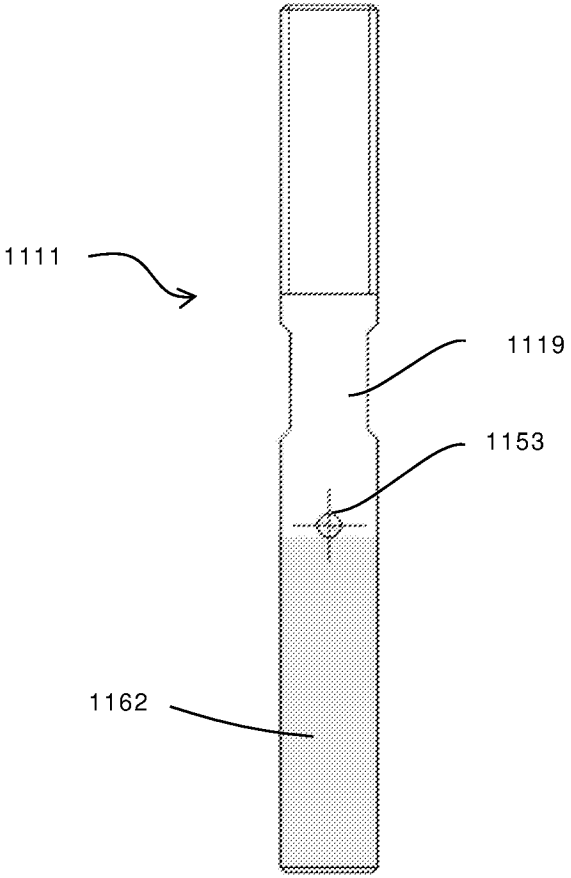
FIG. 16 is an elevation view of the stem of the bracket of FIG. 15.
Figure 15:
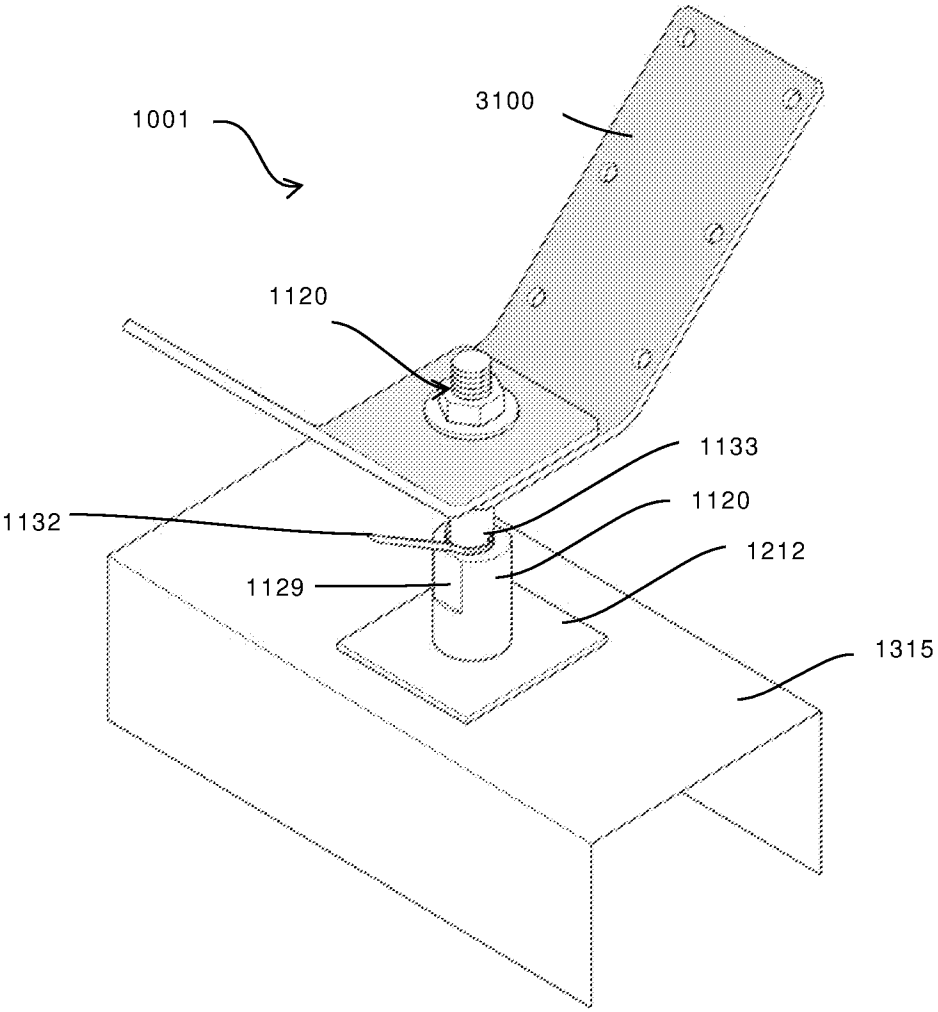
FIG. 15 is a perspective view of an embodiment of bracket.
Figure 17C:
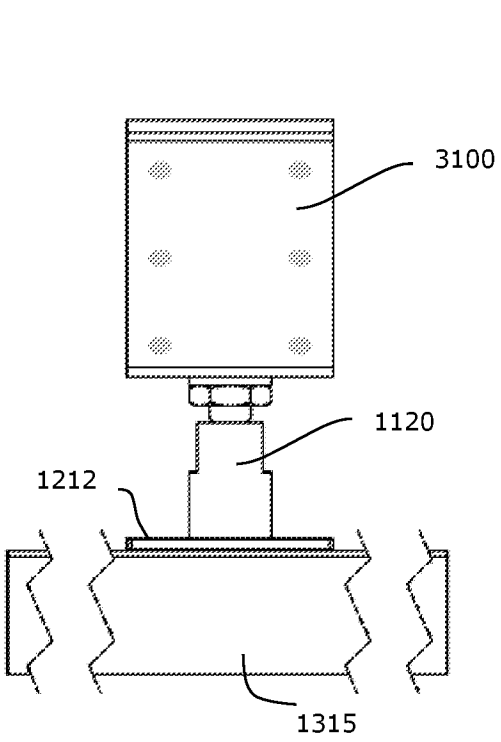
FIGS. 17*a* to 17*c* are side views illustrating the operation of the bracket of FIG. 15, where
Figure 17B:
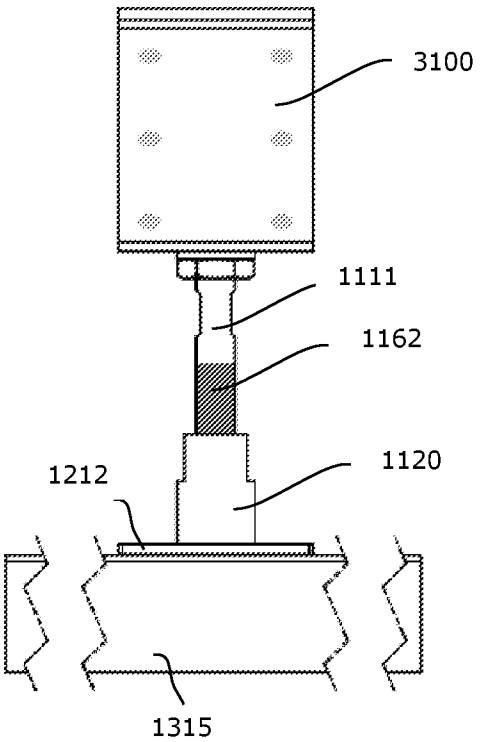
Figure 17A:
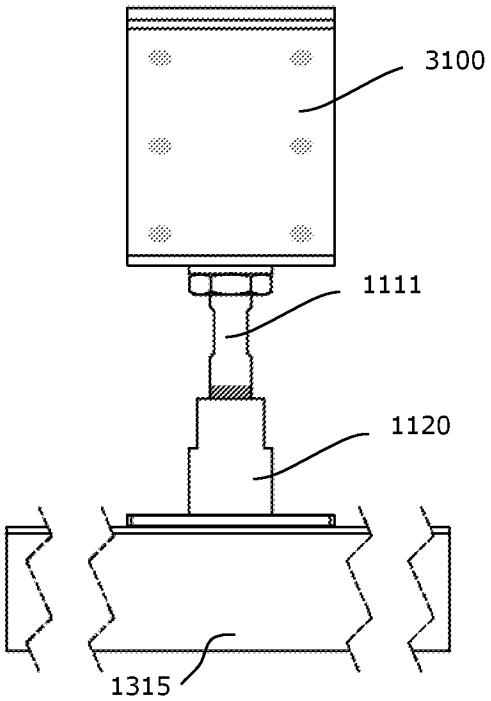

Referring to FIG. 16, as a further alternative, an aperture 1133 may be provided only in the shaft, and the locking member 1132 extends through this shaft aperture 1133. The lower end of the shaft 1111 is then inserted into the hollow of the sheath until the locking member 1132 rests on the top rim of the sheath 1120, limiting further downwards movement of the shaft 1111 to prevent the bracket compressing and thereby assisting with installation. To this end, the aperture 1133 in the shaft is spaced from the lower end of the shaft 1111 and will be positioned in the hollow of the sheath on compression of the bracket, and above the sheath 1120 on extension of the bracket. After installation, the locking member 1132 can be removed to allow normal operation of the bracket.

Figure 14C:
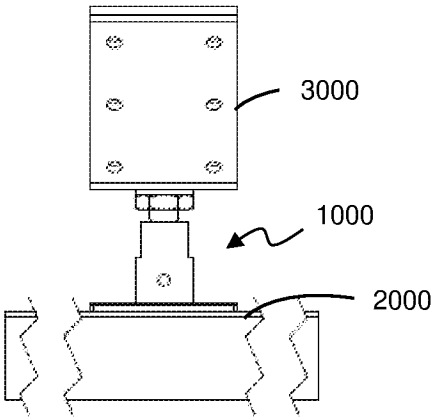
FIG. 14*c* shows the bracket assembly of FIG. 14*a* in which the partition wall bracket is in a contracted position.
Figure 14B:
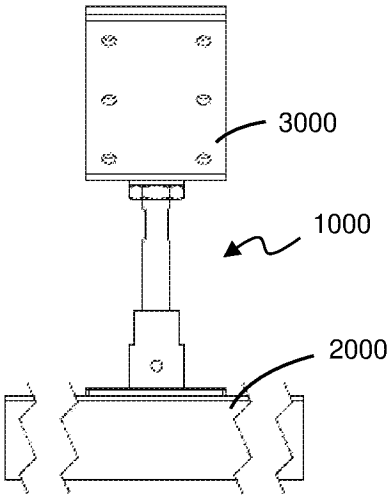
FIG. 14*b* shows the bracket assembly of FIG. 14*a* in which the partition wall bracket is in an extended position.
Figure 14A:
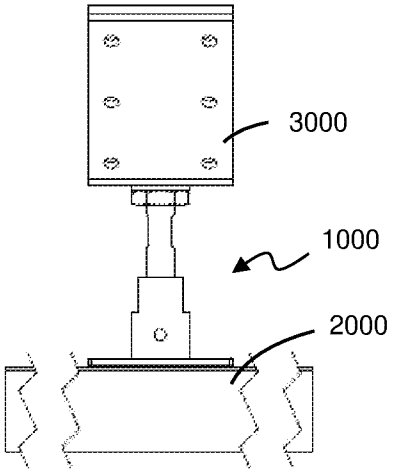
FIG. 14*a* is a schematic side view of one form of bracket assembly in which the partition wall bracket is in a neutral position.

Therefore, in use, the body of the partition wall bracket 1000 provides a length adjustable connection between the partition wall 2000 and an upper structure 3000 by allowing the shaft 1110, 1111 to freely move vertically and substantially unhindered within the sheath 1120 of the bracket 1000 to automatically adjust between an expanded state, as shown in FIGS. 14*b* and 17*b*, and a compressed state, as shown in FIGS. 14*c* and 17*c*. The uninhibited movement of the shaft 1110, 1111 within the sheath 1120 allows the shaft 1110, 1111 to automatically and immediately move within the sheath 1120 to compensate for vertical movement of the wall 2000 and/or upper structure 3000, such as during an earthquake, wind loading or loads from the storey above.

Figure 22:
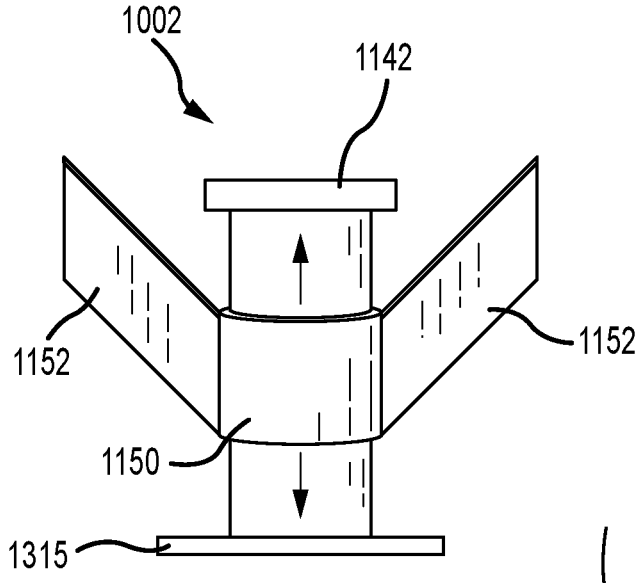
FIG. 22 is a front view of a further alternative embodiment having the shaft attached to the first attachment system and the sheath movable up and down on the shaft.
Figure 23:
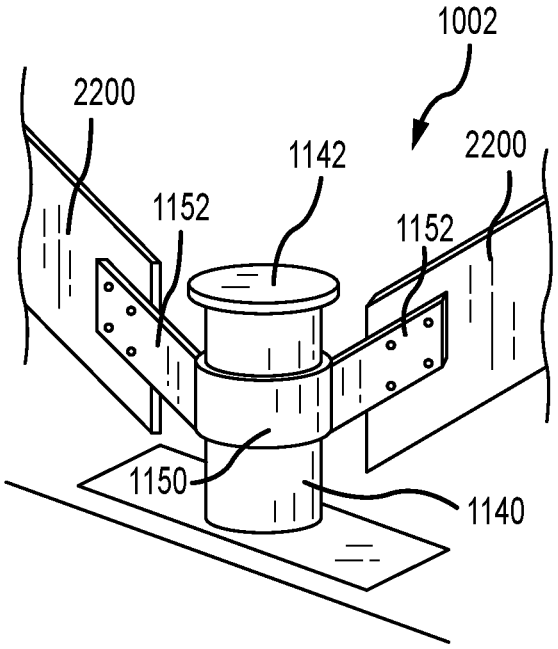
FIG. 23 is a perspective view of the bracket shown in FIG. 20, attached to bracing members.

In further alternative embodiments, the sheath may instead slide up and down on the shaft. FIGS. 22 and 23 illustrate a bracket 1002 according to a further embodiment of the invention. The bracket 1002 comprises an elongate shaft 1140 and a sheath 1150. The shaft 1140 has a first lower end configured to secure to the head track, or partition wall stud or beam (such as a horizontal timber member). This connection is by way of a first attachment system that may be of any suitable form, as described above in relation to the other embodiments, for example, it may screw to a top surface of the head track or wall, or it may clamp to the head track with a nut and washer arrangement.

The sheath 1150 has a hollow for receiving the shaft 1140 such that the sheath is able to slide up and down relative to the shaft 1140. The shaft 1140 and sheath 1150 may be of any suitable shape. In a particularly preferred form, the sheath and shaft are both cylindrical. The hollow interior of the sheath 1140 may also be of any suitable cross section to receive the shaft. Preferably, the hollow of the sheath also has a generally cylindrical interior with a dimension to provide a close fit between the shaft and the sheath, optionally allowing for a sleeve to be positioned between the two members 1140, 1150. In other forms, the hollow region 1123 may comprise an elliptical lateral cross-section or a quadrilateral lateral cross-section, preferably with rounded corners. In some forms, the hollow of the sheath may be enlarged, filleted or may taper outwards at its upper and/or lower openings to facilitate assembly of the bracket and for smoother sliding between the two components. Preferably, the exterior cross-sectional dimensions of the shaft, such as the shaft diameter or width are only slightly smaller than the dimensions of the cross-section of the hollow interior of the sheath, to provide a close fit between the shaft and sheath so that the shaft and the sheath maintain a sliding relationship, but a minimal gap is provided between the shaft and sheath. For example, the gap may be between 0.2 mm (about 0.008 inches) to 3 mm (about 0.12 inches) and is preferably between 0.3 mm (about 0.012 inches) and 1 mm (about 0.04 inches), such as 0.5 mm (about 0.02 inches). The sheath 1150 is configured for attachment to bracing or other connections to the overhead structure. In the embodiment shown in FIGS. 22 and 23, the sheath comprises two integral angled arms 1150 for screwing or otherwise fixing to bracing members. However, it will be understood that other attachment methods are envisaged such as attachments for tensile connectors as described above in relation to other embodiments.

The sheath 1150 is slidable from at or near a first, lower end of the shaft 1140 to at or near a second, upper end of the shaft. That is, to accommodate compressive loads, the sheath 1150 is slidable downwards on the shaft 1140 towards the first end of the shaft until it abuts the head track 1315, first attachment system, or a lower stop. Under lifting or expansion loads, the sheath 1150 is slidable upwards on the shaft 1140 towards its second end until it abuts a stop 1142 provided at or near the top, second end of the shaft 1140. The stop 1142 may be of any suitable form, for example it may be integral with the shaft 1140, or may comprise a nut/washer or other assembly. As described above in relation to the other embodiments, a plastic sleeve or other low-friction sleeve or coating may be provided between the inner surface of the sheath and the outer surface of the shaft.

Figure 24:
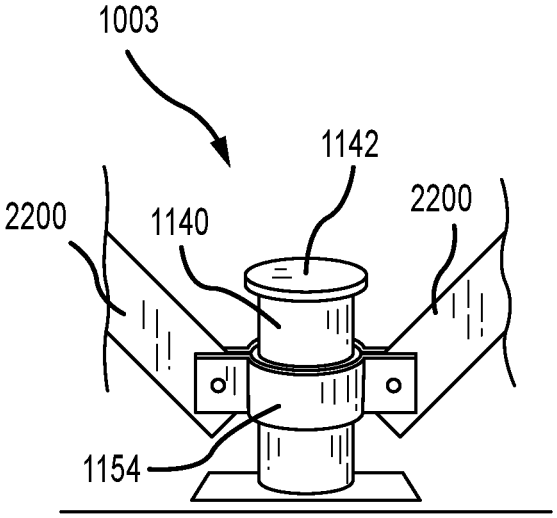
FIG. 24 is a front perspective view of a further embodiment bracket similar to the embodiment of FIG. 20, but with a movable sheath that clamps to the bracing members.

FIG. 24 illustrates a further embodiment of bracket 1003 having an alternative embodiment sheath 1154 slidable on the shaft 1140. In this embodiment, rather than being a generally cylindrical member, the sheath comprises an assembly of two components that clamp together to define a hollow to receive the shaft 1140. Angled bracing members are clamped between the two sheath components by passing a bolt and nut arrangement through one or more holes in the bracing and through the two sheath components. This embodiment 1003 otherwise operates substantially as described above in relation to the embodiment of FIGS. 22 and 23.

The partition wall bracket of the invention allows the position of the shaft and the sheath, relative to each other, to vary along the longitudinal axis of the bracket. That is to say, the shaft or the sheath is slidable relative to the other to adjust the bracket, so that the first and second attachment systems and therefore the partition wall and overhead structure can move toward and away from each other. Thus in each embodiment, the partition wall bracket provides an automatically and freely adjustable connection between a partition wall and an overhead structure, such that the automatic and unhindered movement of the bracket generally precludes compression and expansion actions being transmitted from the overhead structure to the partition wall.

The partition wall brackets of the present invention may be useful for supporting partition walls of buildings (specifically in but not limited to earthquake zones) while allowing for vertical movement caused by loads on the floor above or by building deflection caused by seismic and wind loading events.

The partition wall bracket 1000, 1001, 1002, 1003, etc. of the invention may be particularly useful to support internal glazed partition walls which are prone to pulling apart if ordinarily held by a fixed bracket while being subjected to upward vertical movement. Typically, when the vertical deflection, such as vertical inter-storey deflection, causes the structural ceiling to lift upwards, the aluminium head track, supporting the glass, can be pulled upwards, thereby releasing the connection with the glass. This can result in the glass panels 'popping-out' of the aluminium glazing pockets. In the reverse, under vertical compression forces, the glazing in these partition walls can be crushed. Both these scenarios cause irreversible damage and are a hazard when people are trying to evacuate a building. By using the bracket of the invention, the vertical forces/deflections are generally absorbed by the vertical movement of the bracket, which allows the partition walls to remain supported and reduces the risk that the walls will be damaged by vertical forces. Therefore, the partition wall bracket of the invention may be used to provide a system by which interior partition walls can be supported within a building.

Preferred embodiments of the invention have been described by way of example only and modifications may be made thereto without departing from the scope of the invention.

The invention claimed is:

1. An adjustable partition wall bracket comprising:

a first attachment system configured to attach the bracket to an upper surface of a partition wall;

a second attachment system attached to lateral support bracing configured to attach and laterally restrain the bracket to an upper structure within a ceiling cavity;

a body located between and attached to the first and second attachment systems, the body comprising a shaft and a sheath, the sheath comprising a hollow region configured to slidably receive a portion of the shaft therein;

wherein at least one of the shaft and the sheath are freely slidable up and down relative to the other to automatically adjust a length of the body between an expanded state and a compressed state in response to vertical displacements between the wall and the upper structure such that at least one of:

(i) the shaft is freely slidable within the sheath from a first position where a first end of the shaft is at a first distance from a first end of the sheath, towards a second position where the first end of the shaft is at a second distance from the first end of the sheath, or (ii) the sheath is freely slidable over the shaft from a first position where the first end of the sheath is at a first distance from the first end of the shaft, towards a second position where the first end of the sheath is at a second distance from the first end of the shaft.

2. The partition wall bracket of claim 1, wherein the shaft is longer than the sheath.

3. The partition wall bracket of claim 1, wherein the shaft comprises an extension portion, which is receivable within the hollow region of the sheath, and an attachment portion; and the sheath comprises a stabilising portion and an attachment portion; and wherein the extension portion of the shaft is longer than the stabilising portion of the sheath.

4. The partition wall bracket of claim 1, wherein the portion of the shaft that is slidably received within the hollow region of the sheath is movable longitudinally within the sheath.

5. The partition wall bracket of claim 1, wherein the shaft is slidable from a position in which a majority portion of the shaft is positioned below a top of the sheath, to a position where a majority portion of the shaft is positioned above a top of the sheath.

6. The partition wall bracket of claim 1, wherein the hollow region of the sheath extends from a first end of the sheath to a second end of the sheath to form a tubular sheath comprising a circular cross-section and wherein the shaft is substantially cylindrical.

7. The partition wall bracket of claim 1, wherein the bracket comprises a biasing member to bias the bracket towards a neutral, installation position.

8. The partition wall bracket of claim 1, wherein the partition wall comprises a head track, and the first attachment system attaches to the head track.

9. The partition wall bracket of claim 1, wherein the lateral support bracing comprises one or more lateral support brackets or tension member restraints to attach to the upper structure to restrain lateral movement of the partition wall.

10. The partition wall bracket of claim 1, wherein the sheath comprises a first end and a second end, wherein the first end of the sheath is attachable to the first attachment system.

11. The partition wall bracket of claim 1, wherein the shaft comprises an attachment portion located at or near an end of the shaft for engaging with the second attachment system.

12. The partition wall bracket of claim 1, wherein the shaft is longitudinally movable between about 50 mm (about 1.97 inches) and about 75 mm (about 2.95 inches) from a neutral position.

13. The partition wall bracket of claim 1, further comprising a removable locking member extending through at least one of the shaft and the sheath to limit downwards movement of the shaft relative to the sheath.

14. The partition wall bracket of claim 1, wherein the body comprises a first end and a second end, and wherein the first end is attachable to the first attachment system and the second end is attachable to the second attachment system.

15. The partition wall bracket of claim 1, wherein the lateral support bracing comprises one or more rigid connectors that comprise a horizontal portion for attachment to the second attachment system, and an angled portion that projects from the horizontal portion at an angle of between about 35° and about 90° to the horizontal portion.

16. The partition wall bracket of claim 1, wherein the lateral support bracing comprises a pair of opposing rigid or tensile connectors, each comprising a horizontal portion for attachment to the second attachment system, and an angled portion that projects from the horizontal portion at an angle of about 45° to the bracket body.

17. The partition wall bracket of claim 1, wherein the shaft or the sheath comprises opposing gripping portions to facilitate gripping of the bracket body by a tool during installation.

18. The partition wall bracket of claim 1, wherein the sheath is slidable from at or near a first, lower end of the shaft to at or near a second, upper end of the shaft.

19. The partition wall bracket of claim 18, wherein a stop is provided at or near a second end of the shaft to limit movement of the sheath along the shaft.

20. The partition wall bracket of claim 1, wherein a lining member is positioned at least partly within the hollow region of the sheath.

21. The partition wall bracket of claim 20, wherein the lining member is a lining sleeve provided on at least a portion of the shaft and comprises a coating on an exterior surface of the shaft.

22. The partition wall bracket of claim 1, wherein the second attachment system is attachable to lateral bracing that comprises at least one of the group consisting of: an angle bracket, a channel bracket, one or more rigid connectors, or one or more tensile member connectors to inhibit lateral movement of the partition wall.

23. The partition wall bracket of claim 22, wherein the lateral support bracing comprises at least one rigid connector comprising a horizontal portion for attachment to the second attachment system, and an angled portion for fastening to the upper structure.

24. The partition wall bracket of claim 23, wherein the lateral support bracing comprises multiple rigid connectors, each comprising a horizontal portion with an aperture therein, the horizontal portions being arranged to overlay each other with the apertures concentric to receive an end of the bracket body therein.

25. The partition wall bracket of claim 24, wherein each rigid connector is rotatable about a respective aperture of the rigid connector, relative to the other rigid connector(s) and the bracket body.

* * * * *